US005593820A

United States Patent [19]

Shirai

[11] Patent Number: 5,593,820

[45] Date of Patent: Jan. 14, 1997

[54] SILVER HALIDE EMULSION AND SILVER HALIDE PHOTOGRAPHIC MATERIAL USING THE SAME

[75] Inventor: Hideyuki Shirai, Kanagawa, Japan

[73] Assignee: Fuji Photo Film Co., Ltd., Kanagawa, Japan

[21] Appl. No.: 360,001

[22] Filed: Dec. 20, 1994

[30] Foreign Application Priority Data

Dec. 20, 1993 [JP] Japan ..... 5-320112

[51] Int. Cl.[6] ..... G03C 1/035; G03C 1/18

[52] U.S. Cl. ..... 430/567; 430/569; 430/585; 430/603; 430/605

[58] Field of Search ..... 430/585, 583, 430/567, 569, 572, 574, 603, 605

[56] References Cited

U.S. PATENT DOCUMENTS

| | | | |
|---|---|---|---|
| 4,063,951 | 12/1977 | Bogg | 430/567 |
| 4,386,156 | 5/1983 | Mignot | 430/567 |
| 4,830,958 | 6/1989 | Okumura et al. | 430/585 |
| 5,112,731 | 5/1992 | Miyasaka | 430/567 |
| 5,264,337 | 11/1973 | Maskosky | 430/567 |
| 5,316,904 | 5/1994 | Parton et al. | 430/567 |
| 5,356,764 | 10/1994 | Szajewski et al. | 430/567 |
| 5,422,237 | 6/1995 | Kato et al. | 430/583 |

FOREIGN PATENT DOCUMENTS

| | | |
|---|---|---|
| 0534395 | 3/1993 | European Pat. Off. . |
| 675654 | 7/1952 | United Kingdom . |

*Primary Examiner*—Lee C. Wright

*Attorney, Agent, or Firm*—Sughrue, Mion, Zinn, Macpeak & Seas

[57] ABSTRACT

A silver halide emulsion is described, which contains tabular silver halide grains having {100} faces as the parallel two major planes, having an aspect ratio of 2 or more and having a mean silver chloride content of 50 mol % or more, in an amount of 50% or more of the total projected area of all the silver halide grains therein, and which is spectrally sensitized with a particular trimethine dye of formula (I). A photographic material having the emulsion has a high sensitivity and good storability and can be processed rapidly.

5 Claims, No Drawings

SILVER HALIDE EMULSION AND SILVER HALIDE PHOTOGRAPHIC MATERIAL USING THE SAME

FIELD OF THE INVENTION

The present invention relates to a silver halide photographic material and, in particular, to a silver halide emulsion having excellent photographic sensitivity and to a photographic material using the emulsion.

BACKGROUND OF THE INVENTION

A demand for rapid processing of silver halide photographic material is increasing in these days. In general, silver bromide is used in photographic materials. However, for rapid processing of photographic materials, it is desirable that silver chloride is used in them. However, silver chloride grains have problems in that they weakly adsorb dyes, that they are weakly sensitized with spectral sensitizing dyes and that the storability of the grains themselves is poor. Accordingly, the use of tabular grains having large surface area and having large adsorptive capacity of dye in silver halide photographic materials is advantageous. As tabular grain, tabular grains having {111} faces as the major planes are generally used in view of the easiness of the production, the photographic sensitivity and the sharpness of the materials. However, the tabular grains having {111} faces as the major planes have a problem in that their intrinsic desensitization due to dyes is great.

According to A. Mignot, E. Francois & M. Catinat, "Cristaux de Rbomure D'argent Plats, Limites par des Faces (100) et non Macles", Journal of Crystal Growth 123 (1974), 207–213, it is reported that they have observed tabular silver bromide crystals with {100} faces having square or rectangular major planes.

According to the disclosure of U.S. Pat. No. 4,063,951, the tabular grains with {100} crystalline faces are formed from monodisperse seed grains and they are ripened in the presence of ammonia to have a mean aspect ratio falling within the range between 1.5 and 7. U.S. Pat. No. 4,386,156 mentions a method for producing emulsions of tabular silver bromide grains, in which seed grains are ripened in the absence of a non-halide complexing agent for silver ions, to form tabular silver bromide grains having a mean aspect ratio of 8 or more. A method for producing tabular grains having a high silver chloride content is illustrated in EP-A-534395.

The inventors of the present invention tried to use the tabular grains having {100} faces as the major planes as silver halide grains to confirm that such tabular grains cannot meet practical use because they particularly weakly adsorb dyes.

Accordingly, the inventors have conducted extensive investigations in order to obtain dyes excellent in adsorption on tabular silver halide grains having {100} faces as the major planes, and have achieved the present invention.

SUMMARY OF THE INVENTION

The present invention is to produce a high-sensitivity silver halide emulsion having excellent storability and rapid processability by spectrally sensitizing an emulsion of high-silver chloride tabular grains having {100} faces as the major planes with a dyes having a particular structure, providing a photographic material having the emulsion.

Specifically, the present invention provides a silver halide emulsion which contains tabular silver halide grains having {100} faces as the parallel two major planes, having an aspect ratio of 2 or more and having a mean silver chloride content of 50 mol % or more, in an amount of 50% or more of the total projected area of all the silver halide grains therein, and which is spectrally sensitized with a dye represented by a formula (I):

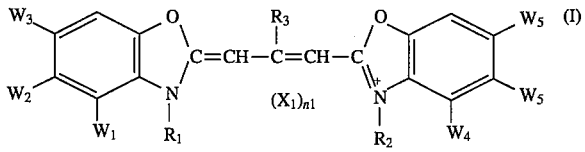

(I)

wherein $W_1$, $W_3$, $W_4$ and $W_6$ each represents a hydrogen atom;

$W_2$ and $W_5$ each represents a bromine atom, or an unsubstituted or substituted phenyl group; and $W_2$ may be bonded to $W_1$ or $W_3$, and $W_5$ may be bonded to $W_4$ or $W_6$, to form a benzene ring;

$R_1$ and $R_2$ may be the same or different and each represents an unsubstituted or substituted alkyl or alkenyl group having 10 or less carbon atoms in total, and at least one of $R_1$ and $R_2$ has a sulfo group or a carboxyl group;

$R_3$ represents a lower alkyl group or a phenyl-substituted alkyl group;

$X_1$ represents a pair ion necessary for neutralizing the charge of the compound; and $n_1$ represents 0 or 1, and when the compound is an internal salt, then $n_1$ is 0.

The present invention also provides a silver halide photographic material comprising a support having provided thereon at least one silver halide emulsion layer containing the emulsion mentioned above.

As one preferred embodiment of the present invention, the tabular silver halide grains in the emulsion layer are sensitized by gold-sensitization and sulfur-sensitization.

As another preferred embodiment of the present invention, the tabular silver halide grains in the emulsion layer are sensitized by gold-sensitization and sulfur-sensitization in the presence of the dye represented by the formula (I).

DETAILED DESCRIPTION OF THE INVENTION

The emulsion of high-silver chloride tabular grains of the present invention can be produced according to the process mentioned below.

1) Nucleation Step:

Tabular nuclei for tabular grains are produced at a high rate under conditions under which lattice defects are easily introduced thereinto. To produce tabular nuclei with good reproducibility at a high rate, halogen conversion of nuclei formed is effectively employed. This comprises forming silver halide nuclei followed by introducing thereinto halide ions capable of producing more hardly-soluble silver halide for halogen conversion of the nuclei.

More concretely, silver halide nuclei, for example, having a halide composition structure of ($AgX_1|AgX_2$) or ($AgX_1|AgX_4|AgX_3$) are first formed at the nucleation step. The structure can be formed, for example, by mixing an aqueous solution of a silver salt (hereinafter referred to as "$Ag^+$ solution" and aqueous solutions of halides (hereinafter referred to as "$X^-$ solutions") by a double jet method so that the halide composition of the $X^-$ solution is discontinuously varied at the gap. Alternatively, one $X^-$ solution is added to a solution of a dispersing medium, then an $Ag^+$ solution is added thereto to form $AgX_1$, and thereafter another $X^-$ solution is added thereto, then an $Ag^+$ solution is added thereto to finally form a structure of $(AgX_1|AgX_2)$. These methods can be combined, if desired.

In the above-mentioned structures, $AgX_1$ and $AgX_2$; $AgX_1$ and $AgX_4$; and $AgX_4$ and $AgX_3$ are different from each other in the $Cl^-$ content or the $Br^-$ content by from 25 to 100 mol %, preferably from 50 to 100 mol %, more preferably from 75 to 100 mol %, and/or are different from each other also in the $I^-$ content by from 5 to 100 mol %, preferably from 10 to 100 mol %, more preferably from 30 to 100 mol %. In addition to these, also mentioned is an embodiment having a difference in the $I^-$ content by from 0 to 5 mol % as combined with the difference in the $Cl^-$ content or the $Br^-$ content defined above. These nuclei preferably have a grain size of 0.15 μm or less, more preferably from 0.01 to 0.1 μm.

The molar ratio of $AgX_1$:$AgX_2$ in $(AgX_1|AgX_2)$ and that of $AgX_1$:$AgX_4$:$AgX_3$ in $(AgX_1|AgX_4|AgX_3)$ can be varied, and the best molar ratio for the best embodiment of the present invention shall be selected.

The solution of the dispersion medium for the nucleation must have an atmosphere in which {100} faces are formed. Almost all ordinary conditions for the nucleation to be conducted in an excess $Cl^-$ concentration (pCl of from 0.8 to 3.0, pH of from 2 to 9) are in an atmosphere for forming {100} faces. Within a pH range of from 1 to 7, the defect-forming frequency is higher, when the pH is higher and when the pCl is higher. pCl as referred to herein is represented by "pCl=−log[mol of $Cl^-$/liter].

In the solution of a dispersing medium for the nucleation, it is preferred that the concentration of the dispersing medium in the solution is from 0.1 to 10% by weight, more preferably from 0.3 to 5% by weight. The pH in the solution is preferably from 1 to 10, more preferably from 2 to 8. The temperature for the nucleation is preferably from 10° to 80° C., more preferably from 30° to 60° C.. The excess $Br^-$ concentration is preferably $10^{-2}$ mol/liter or less, more preferably $10^{-2.5}$ mol/liter or less. The excess $Cl^-$ concentration is preferably such that pCl=0.8 to 3.0, more preferably pCl=1.2 to 2.8.

To uniformly conduct the nucleation, a dispersing medium may be added to the $Ag^+$ solution and/or the $X^-$ solutions. The concentration of the dispersing medium to be added is preferably 0.1% by weight or more, more preferably from 0.1 to 2% by weight, further more preferably from 0.2 to 1% by weight. As the dispersing medium, especially preferred is a low-molecular gelatin having a molecular weight of from 3,000 to 60,000, preferably from 8,000 to 40,000. It is more preferred that the $Ag^+$ solution and the $X^-$ solutions are directly introduced into the reaction system each through a porous substance having pores of from 3 to $10^{15}$, preferably from 30 to $10^{15}$. For the details of such addition, the disclosures in JP-A-3-21339, JP-A-4-193336 and JP-A-6-86923 are referred to. (The term "JP-A" as referred to herein means an "unexamined published Japanese patent application".) A gelatin having a low methionine content is preferred, since the defect-forming frequency is high when such a gelatin is used. Therefore, the most preferred gelatin shall be selected from gelatins having a methionine content of from 1 to 60 μmol/g, case by case.

When the excess $X^-$ salt concentration or the excess $Ag^+$ salt concentration is lowered in the nucleation, the proportion of twin crystals in the nuclei formed may be lowered.

To conduct the nucleation, an aqueous solution of a silver salt and solution(s) of halide(s) (hereinafter referred to as "$X^-$ salt (s)") are added to a solution comprising at least water and a dispersing medium, while stirring by a double jet method.

The $Cl^-$ concentration in the solution of the dispersing medium during the nucleation is preferably $10^{-1.5}$ mol/liter or less, and the $Ag^+$ concentration in the same is preferably $10^{-2}$ mol/liter or less. The pH in the solution is preferably 2 or more, more preferably from 5 to 10. The gelatin concentration in the solution is preferably from 0.1 to 3% by weight, more preferably from 0.2 to 2% by weight.

The temperature for the nucleation is not specifically defined but, in general, it is preferably 10° C. or higher, more preferably from 20° to 70° C. After the nucleation, the nuclei formed are subjected to physical ripening, by which the non-tabular grains are removed while only the tabular grains are grown. The addition speed of the aqueous solution of a silver salt is preferably from 0.5 to 20 g/min, more preferably from 1 to 15 g/min, per liter of the solution in the container. The pH value of the solution in the container is not specifically defined but, in general, it may be from 1 to 11, preferably from 3 to 10. The best pH value shall be selected in accordance with the combination of the excess silver salt concentration and the temperature.

2) Ripening Step:

It is impossible to produce only tabular nuclei by the nucleation. Therefore, the tabular nuclei formed must be subjected to Ostwald ripening in the next ripening step, in which the tabular nuclei are grown while the other nuclei are removed. The ripening temperature may be 40° C. or higher, preferably from 45 to 90° C., more preferably from 50° to 80° C.

The ripening is preferably conducted in an atmosphere in which {100} faces are formed. The ripening conditions are preferably selected from the conditions for the nucleation mentioned above. Within the pH range of from 1 to 6, in general, the ripening speed is higher when the pH is higher. Within the pCl range of from 1 to 3, the ripening speed is higher when the $Cl^-$ concentration is higher.

In the present invention, it is preferred that the ripening of the tabular nuclei is conducted substantially in the absence of a silver halide solvent. The wording "substantially in the absence of a silver halide solvent" as referred to herein means that the concentration of the silver halide solvent "$d_0$" is such that $d_0 \leqq 0.5$ mol/liter, more preferably $d_0 < 0.1$ mol/liter, further more preferably $d_0 < 0.02$ mol/liter.

The pH in the ripening system may be from 1 to 12, preferably from 2 to 8, more preferably from 2 to 6.

As dispersion media for the nucleation and the ripening and the growth of tabular nuclei, any of known dispersion media for silver halide emulsions can be employed. However, especially preferably employed is gelatin having a methionine content of from 0 to 50 μmol/g, more preferably from 0 or 30 μmol/g. When such gelatin is used in during the ripening and the growth of the tabular nuclei formed, then thinner tabular grains having a uniform grain size distribution can be obtained favorably. In addition, synthetic high polymers such as those described in JP-B-52-16365 (the term "JP-B" as used herein means an "examined Japanese patent publication"); Journal of Photographic Association of Japan, Vol. 29 (1), 17, 22 (1966); ibid., Vol. 30 (1), 10, 19 (1967); ibid., Vol. 30 (2), 17 (1967); ibid., Vol. 33 (3), 24 (1967) are also preferably employed as the dispersion media. Further, a crystal habit controlling agent such as those described in EP-A-534395 may also be employed along with the dispersion media. The concentration of the dispersion medium is preferably from 0.1 to 10% by weight, and the concentration of the crystal habit controlling agent is preferably from $10^{-1}$ to $10^{-6}$ mol/liter, more preferably from $10^{-2}$ to $10^{-5}$ mol/liter. These can be added to the reaction system at any stage from before the nucleation to after the growth of tabular nuclei. These can be added to the already-existing dispersing medium or, alternatively, can be added to the reaction system after the already-existing dispersing medium has been removed therefrom by centrifugation, etc.

3) Growing Step:

After the proportion of the tabular grains has been elevated in the ripening step mentioned above, solutes are added thereto and the tabular grains are grown further. To add solutes to the tabular grains, employable are (1) a solution addition method in which an aqueous solution of a silver salt and solution(s) of halide(s) are added to them, (2) a method of forming fine silver halide grains followed by adding said fine grains to them, and (3) a combination of the two methods. To grow the tabular grains predominantly in the direction of the edges, it is necessary that the tabular grains are grown at a lowered super-saturation concentration within the range where the grains are not ripened by Ostwald ripening. For this, it is necessary to control the lowered super-saturation concentration with accuracy. The method (2) is preferred, by which the control is possible.

According to the method of adding an emulsion of fine silver halide grains to the tabular grains, an emulsion of fine silver halide grains having a grain size of 0.15 μm or less, preferably 0.1 μm or less, more preferably 0.06 μm or less is added to the tabular grains and the tabular grains are grown by Ostwald ripening in the presence of the emulsion. The emulsion of fine grains can be added either continuously or intermittently. The emulsion of fine grains may be prepared continuously in a mixer disposed near the reactor where the tabular grains are grown, by adding an aqueous solution of a silver salt and aqueous solution(s) of halide(s), and, immediately after the preparation, the thus-prepared emulsion may be continuously added to the reactor; or alternatively, the emulsion may be prepared batchwise in a separate container and then it may be added continuously or intermittently to the reactor where the tabular grains are grown. It is preferred that the fine grains do not substantially contain any twin-crystalline grains. The wording "do not substantially contain any twin-crystalline grains" as referred to herein means that the content of twin-crystalline grains is 5% or less, preferably 1% or less, more preferably 0.1% or less.

The halide composition of said fine grains may be any of silver chloride, silver bromide, silver iodide and mixed crystals of two or more of these.

The conditions of the solution where the tabular grains are grown are the same as those for the ripening step mentioned above. This is because both the ripening step and the growing step are mechanically the same in that the tabular grains only are grown by Ostwald ripening while the other fine grains are removed in the both steps. For the details of the addition of an emulsion of fine silver halide grains, the disclosures in JP-A-4-34544, JP-A-5-281640 and JP-A-1-183417 are referred to.

To produce fine silver halide grains substantially not having any twin planes, an aqueous solution of a silver salt and solution(s) of halide(s) are added by a double jet method, at an excess halide ion concentration or an excess silver ion concentration of $10^{-2}$ mol/liter or less.

The temperature at which the fine silver halide grains are produced is preferably 50° C. or lower, more preferably from 5° to 40° C., further more preferably from 10° to 30° C. As the dispersion medium for the reaction, preferred is gelatin containing a low-molecular gelatin having a molecular weight of from 2,000 to $6\times10^4$, more preferably from 5,000 to $4\times10^4$, at the rate of 30% by weight or more, preferably 60% by weight or more, more preferably 80% by weight or more. The concentration of the dispersion medium is preferably 0.2% by weight or more, more preferably from 0.5 to 5% by weight.

During the nucleation step, it is desirable that the reaction system does not substantially contain $NH_3$. To the wording "does not substantially contain $NH_3$" as referred to herein, the above-mentioned definition shall apply. It is also desirable that no $NH_3$ is substantially coexistent during the growing step. The wording "no $NH_3$ is substantially coexistent" means that the $NH_3$ concentration "$Z_1$" is such that $Z_1 \leqq 0.5$ mol/liter, more preferably $Z_1<0.1$ mol/liter, further more preferably $Z_1<0.02$ mol/liter. It is also desirable that any other AgX solvent than $NH_3$ is also substantially absent in the reaction system during the nucleation step and the growing step. To the wording "substantially absent" as referred to herein, the same definition as that for the concentration $Z_1$ mentioned above shall apply. As other AgX solvents than $NH_3$, there are mentioned antifoggants such as thioethers, thioureas, thiocyanates, organic amine compounds and tetrazaindene compounds. Of these, preferred are thioethers, thioureas and thiocyanates.

Dislocation lines can be introduced into the silver halide grains during their formation by a halide composition gap method, a halogen conversion method, an epitaxial growth method and a combination of these. The introduction of dislocation lines into the grains is preferred, since the stress mark resistance and the reciprocity characteristics and the spectral sensitizing characteristics of the grains are much improved. In this connection, the disclosures in JP-A-63-220238, JP-A-64-26839, JP-A-2-127635, JP-A-3-189642, JP-A-3-175440, JP-A-2-123346, EP-A-460656, and Journal of Imaging Science, Vol. 32,160-177 (1988) are referred to.

From the thus-obtained grains, as host grains, epitaxial grains can be formed. Grains having dislocation lines therein can be formed from the thus-obtained grains, as cores. In addition, the thus-obtained grains, as substrate grains, can be laminated with silver halide layer(s) having different halide compositions from those of the substrate grains, to form grains having various known grain structures. For these, the disclosures in the literatures mentioned hereinafter are referred to.

Using the thus-obtained tabular grains as cores, shallow internal latent image emulsions can be formed. In addition, core/shell grains can be formed from the tabular grains. For these, the disclosures in JP-A-59-133542, JP-A-63-151618, and U.S. Pat. Nos. 3,206,313, 3,317,322, 3,761,276, 4,269,927, and 3,367,778 are referred to.

The most important parameter to finally obtain silver halide grains having a high aspect ratio is, as mentioned above, the pAg value during the ripening step and the growing step. The tabular grains for use in the present invention have an aspect ratio of from 2 to 15, preferably from 3 to 13, more preferably from 4 to 10. The thus-defined range of the aspect ratio of the grains is preferred essentially in view of the sensitivity and the pressure resistance of the grains.

The "aspect ratio" as referred to herein means a ratio of the thickness between the major planes of each grain to the mean length of the sides to form the major planes of the same grain. The "major planes" as referred to herein are defined to be a pair of parallel planes having the largest area on the surface of the crystal of a substantially cubic silver halide grain. The major planes of {100} faces can be determined by electronic diffractometry or X-ray diffractometry. In a substantially cubic silver halide grain, the major planes are {100} faces, but the grain may have from 1 to 8 {111} crystalline faces. Namely, the grain may have a modified cubic structure in which from 1 to 8 corners of eight corners of the cubic are cut off. The "mean length of the sides" is defined to be a length of one side of a square having the same area as the projected area of each grain seen in a microscopic photograph of the emulsion sample.

In order to effectively achieve the effect of the present invention, the silver halide emulsion of the present invention contains the above-mentioned tabular silver halide grains in an amount of 50% or more, preferably 60% or more, more preferably 70% or more of the total projected area of all the silver halide grains therein. The uppermost limit of the content of the tabular grains in the emulsion is 100%.

The present invention is based on the finding that a dye having a particular structure is adsorbed onto the surfaces of tabular silver halide grains having {100} faces as the major planes, the grains having been formed by a process comprising the steps of nucleation, ripening of the nuclei formed and growth of the ripened nuclei. The present invention is characterized in that the mean silver chloride content in said tabular silver halide grains in the emulsion is from 50 mol % to less than 100 mol %, preferably from 70 mol % to 99.99 mol %, more preferably from 80 mol % to 99.95 mol %.

The silver halide emulsion of the present invention is spectrally sensitized with a sensitizing dye of formula (I) mentioned above.

In formula (I), $W_1$, $W_3$, $W_4$ and $W_6$ each represents a hydrogen atom; $W_2$ and $W_5$ each represents a bromine atom, or an unsubstituted or substituted phenyl group; and $W_2$ may be bonded to $W_1$ or $W_3$, and $W_5$ may be bonded to $W_4$ or $W_6$, to form a benzene ring.

As examples of the substituent for the substituted phenyl group, mentioned are a non-branched or branched alkyl group having 5 or less carbon atoms (e.g., methyl, ethyl, butyl, isobutyl, pentyl), an alkoxy group having 4 or less carbon atoms in total (e.g., methoxy, ethoxy, propoxy, butoxy, methoxymethoxy, methoxyethoxy), a chlorine atom, a bromine atom, and an acylamino group having 4 or less carbon atoms (e.g., acetylamino, propionylamino). The phenyl group may be substituted by one or more, same or different substituents such as those mentioned above.

In formula (I), $R_1$ and $R_2$ may be the same or different and each represents an unsubstituted or substituted alkyl or alkenyl group having 10 or less carbon atoms in total, and at least one of $R_1$ and $R_2$ has a sulfo group or a carboxyl group. As preferred examples of the substituent for the alkyl and alkenyl groups, mentioned are a sulfo group, a carboxyl group, a halogen atom, a hydroxyl group, an alkoxy group having 6 or less carbon atoms, an unsubstituted or substituted aryl group having 8 or less carbon atoms (e.g., phenyl, tolyl, sulfophenyl, carboxyphenyl), a heterocyclic group (e.g., furyl, thienyl), an unsubstituted or substituted aryloxy group having 8 or less carbon atoms (e.g., chlorophenoxy, phenoxy, sulfophenoxy, hydroxyphenoxy), an acyl group having 8 or less carbon atoms (e.g., acetyl, propionyl), an alkyl- or phenyl-sulfonyl group having 8 or less carbon atoms (e.g., benzenesulfonyl, methanesulfonyl), an alkoxycarbonyl group having 6 or less carbon atoms (e.g., ethoxycarbonyl, butoxycarbonyl), a cyano group, an alkylthio group having 6 or less carbon atoms (e.g., methylthio, ethylthio), an unsubstituted or substituted arylthio group having 8 or less carbon atoms (e.g., phenylthio, tolylthio), an unsubstituted or substituted carbamoyl group having 8 or less carbon atoms (e.g., carbamoyl, N-ethylcarbamoyl), an acylamino group having 8 or less carbon atoms (e.g., acetylamino), an alkylsulfonylamino group having 8 or less carbon atoms (e.g., methanesulfonylamino), a ureido group, an alkylureido group having 6 or less carbon atoms (e.g., methylureido, ethylureido), an acylaminocarbonyl group having 6 or less carbon atoms (e.g., acetylaminocarbonyl, propionylaminocarbonyl), and an alkylsulfonylaminocarbonyl group (e.g., methanesulfonylaminocarbonyl, ethanesulfonylaminocarbonyl). $R_1$ and $R_2$ each may have one or more substituents such as those mentioned above.

As specific examples of the groups of $R_1$ and $R_2$, mentioned are a methyl group, an ethyl group, a propyl group, an allyl group, a pentyl group, a hexyl group, a methoxyethyl group, an ethoxyethyl group, a phenethyl group, a tolylethyl group, a sulfophenethyl group, a 2,2,2-trifluoroethyl group, a 2,2,3,3-tetrafluoropropyl group, a carbamoylethyl group, a hydroxyethyl group, a 2-(2-hydroxyethoxy-)ethyl group, a carboxymethyl group, a carboxyethyl group, an ethoxycarbonylmethyl group, a sulfoethyl group, a 2-chloro-3-sulfopropyl group, a 3-sulfopropyl group, a 2-hydroxy-3-sulfopropyl group, a 3-sulfobutyl group, a 4-sulfobutyl group, a 2-(2,3-dihydroxypropyloxy)ethyl group, a 2-[2-(3-sulfopropyloxy)ethoxy]ethyl group, a methanesulfonylaminocarbonylmethyl group, a methanesulfonylaminocarbonylethyl group, an ethanesulfonylaminocarbonylethyl group, an acetylaminocarbonyl group, etc.

In formula (I), $R_3$ represents a lower alkyl group (e.g., methyl, ethyl, propyl, butyl), or a phenyl-substituted alkyl group (e.g., benzyl, phenethyl).

In formula (I), $X_1$ represents a pair ion necessary for neutralizing the charge of the compound.

In formula (I), $n_1$ represents 0 or 1, and when the compound is an internal salt, then $n_1$ is 0.

Of sensitizing dyes of formula (I), preferred are those where $R_3$ is an ethyl group or a propyl group, $W_2$ is a substituted phenyl group or is bonded to $W_1$ or $W_3$ to form a benzene ring. Of these, especially preferred are those where $R_3$ is an ethyl group, $W_2$ is a phenyl group substituted by substituent(s) selected from the group consisting of a chlorine atom, a bromine atom, a methoxy group, an ethoxy group, a methyl group and an ethyl group, $W_5$ is a substituted phenyl group or is bonded to $W_4$ or $W_6$ to form a benzene ring.

To incorporate the spectral sensitizing dyes of formula (I) into the silver halide emulsion of the present invention, they may be directly dispersed in the emulsion or, alternatively, after having been dissolved in a single solvent of, for example, water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide, etc., or in a mixed solvent comprising them, the resulting solution may be added to the emulsion.

In addition, also employable are a method of dissolving the dye in a volatile organic solvent, then dispersing the resulting solution in water or a hydrophilic colloid and adding the resulting dispersion to the emulsion., such as that described in U.S. Pat. No. 3,469,987, etc.; a method of directly dispersing the water-insoluble dye in a water-soluble solvent, without being dissolved, followed by adding the resulting dispersion to the emulsion, such as that described in JP-B-46-24185; a method of forming the dye into its aqueous solution or colloidal dispersion in the presence of a surfactant and adding the resulting solution or dispersion to the emulsion, such as that described in U.S.

Pat. Nos. 3,822,135, 4,006,025, etc.; a method of directly dispersing the dye in a hydrophilic colloid and adding the resulting dispersion to the emulsion, such as that described in JP-A-53-102733, JP-A-58-105141, etc.; and a method of dissolving the dye in a solvent in the presence of a red-shifting compound and adding the resulting solution to the emulsion, such as that described in JP-A-51-74624, etc.

To dissolve the dyes, ultrasonic waves may be employed.

To incorporate the spectral sensitizing dyes of formula (I) into the silver halide emulsion of the present invention, the more preferred method is such that they are dissolved in water or a hydrophilic colloid to give their aqueous solutions or they are finely dispersed therein as fine grains having a grain size of 1 μm or less to give their dispersions, and the resulting solutions or dispersions are added to the emulsion. Apart from this, a method of dissolving or finely dispersing the dyes in a water-soluble organic solvent or in an aqueous solution of a water-soluble organic solvent followed by adding the resulting solutions or dispersions to the emulsion is also preferably employed. In this method, it is more preferable that the amount of the organic solvent to be used is 5% by volume or less of the amount of the silver halide emulsion to which the dyes are added.

When the spectral sensitizing dyes of formula (I) have a solubility in water of $5\times10^{-4}$ mol/liter or more at 25° C., then it is also preferred that they are finely pulverized to fine solid grains and the resulting solid grains are directly added to the silver halide emulsion.

The sensitizing dyes of formula (I) can be added to the silver halide emulsion of the present invention at any stage during the process of producing the emulsion, which has heretofore been admitted employable for the purpose. For instance, they may be added thereto during the step of forming silver halide grains or/and before the step of desalting the grains, or during the desalting step and/or from after the desalting step to before the initiation of chemical ripening of the grains, for example, as so illustrated in U.S. Pat. Nos. 2,735,766, 3,628,960, 4,183,756, and 4,225,666, JP-A-58-184142, JP-A-60-196749, etc.; or they may also be added thereto at the stage just before the chemical ripening of the grains or during the chemical ripening step, or at any stage before the coating of the emulsion after the chemical ripening step, as so illustrated in JP-A-58-113920. Anyhow, the dyes may be added to the emulsions at any stage before the emulsions are coated. In addition, referring to the disclosures in U.S. Pat. No. 4,225,666 and JP-A-58-7629, one dye only or a combination of plural dyes having different structures can be added to the emulsion in one step or in plural steps comprising forming the grains and chemically ripening them or after the chemical ripening step, or can be added thereto in plural steps of before, during and after chemical ripening of the emulsion. The kind of the dye or the combination of plural dyes to be added to the emulsion in such manners can be varied.

A pre-determined amount of the dye may be added to the emulsion within a short period of time or within a long period of time. In the latter case, for example, it may be continuously added to the emulsion at any stage during the step of forming the grains from nucleation to the final growth of the grains or almost over the whole period of the chemical ripening step. In this case, the flow rate of the dye to be added to the emulsion may be kept constant all the way or may be accelerated or decelerated.

The temperature at which the sensitizing dyes are added to the emulsions is not specifically defined but, in general, it is from 35° C. to 70° C. It may be different from the ripening temperature. More preferably, the dye is added to the emulsion at 45° C. or lower, then the temperature of the emulsion is elevated and the emulsion is ripened at the elevated temperature.

The amount of the spectral sensitizing dye of formula (I) to be added to the emulsion of the present invention varies, depending on the shape and the size of the silver halide grains in the emulsion. In general, it may be from $4\times10^{-6}$ to $8\times10^{-3}$ mol per mol of silver halide in the emulsion. For instance, if the grain size of the silver halide grains in the emulsion is from 0.2 to 2.0 μm, the dye is added thereto preferably in an amount of from $1.7\times10^{-7}$ to $3.9\times10^{-6}$ mol, more preferably from $8.0\times10^{-7}$ to $2.4\times10^{-6}$ mol, per $m^2$ of the surface area of the silver halide grains.

These spectral sensitizing dyes can be used singly or as a combination of two or more of them. The combination of such spectral sensitizing dyes is often employed fox the purpose of supersensitization.

The emulsion of the present invention may contain, in addition to the spectral sensitizing dye of formula (I), other dyes which do not have any spectral sensitizing effect by themselves or substances which do not substantially absorb visible rays but have supersensitizability.

Specific examples of dyes of formula (I) for use in the present invention are mentioned below, which, however, are not intended to restrict the scope of the present invention.

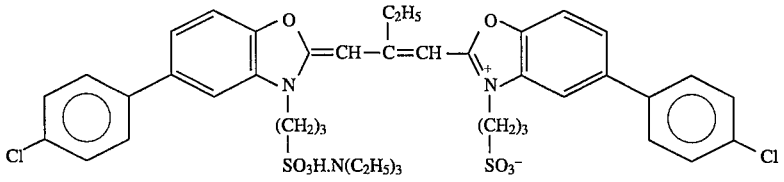

1)

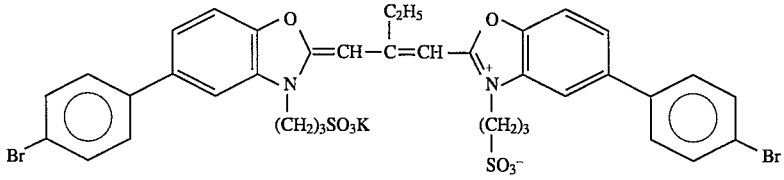

2)

-continued
3)
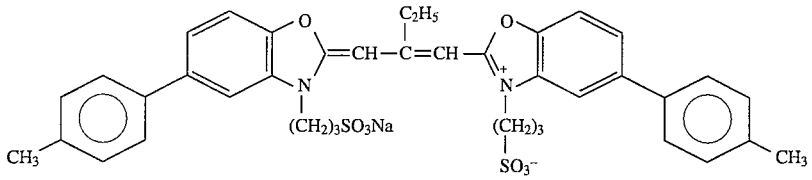
4)
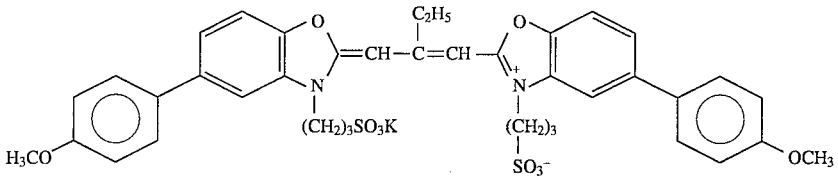
5)
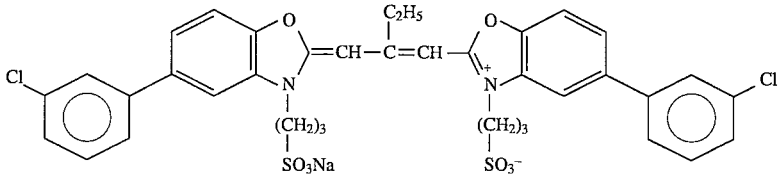
6)
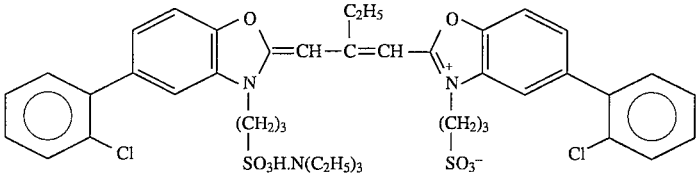
7)
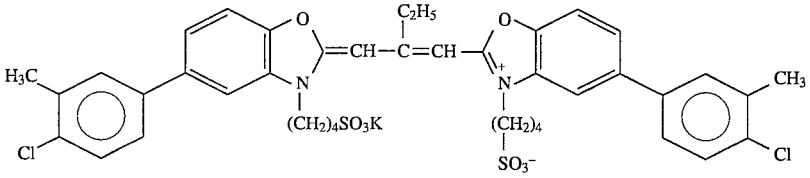
8)
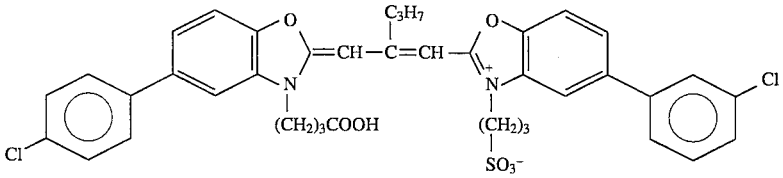
9)
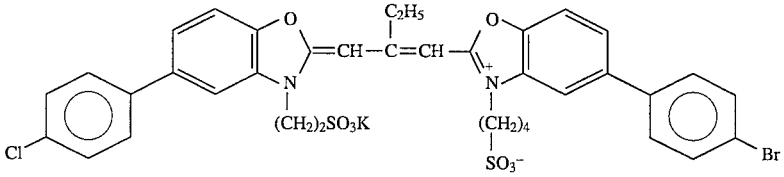
10)
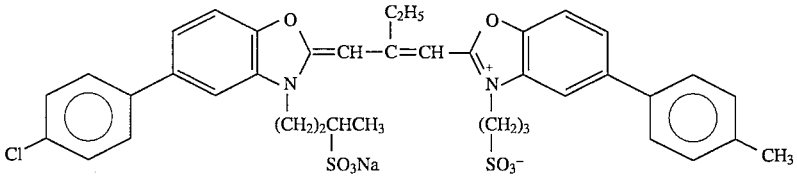
11)
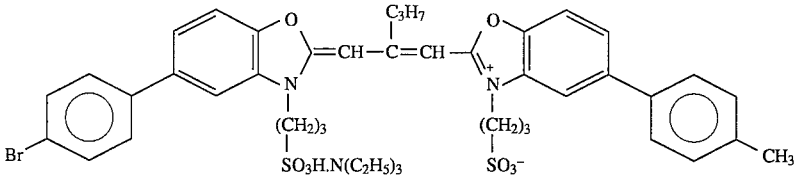

-continued
12)
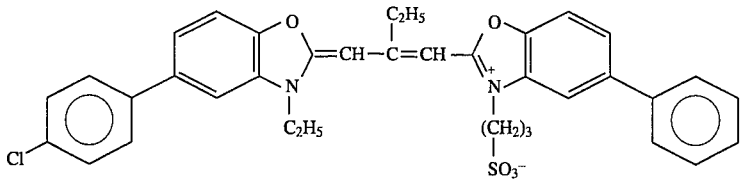
13)
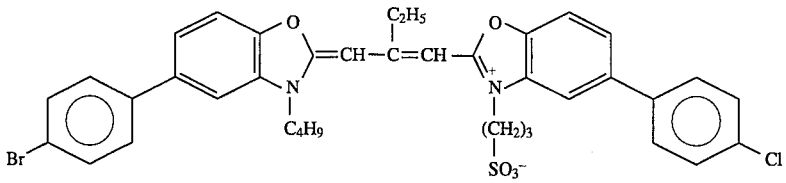
14)
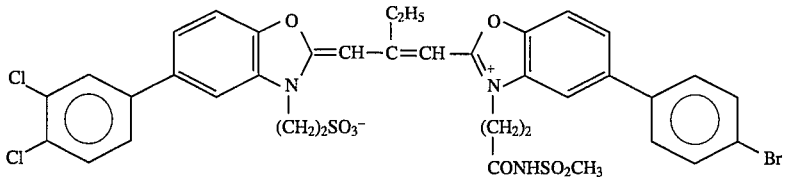
15)
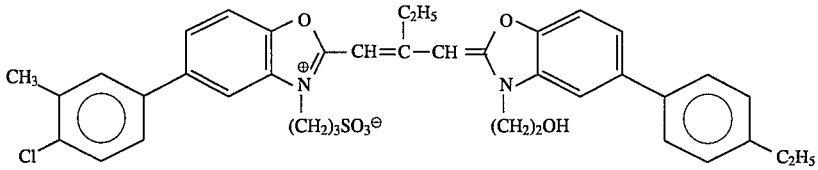
16)
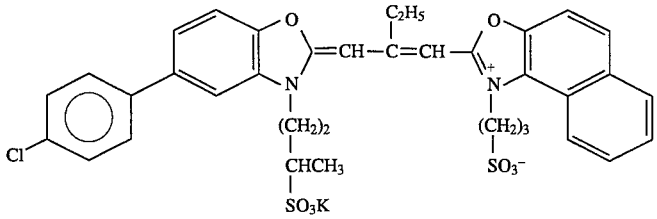
17)
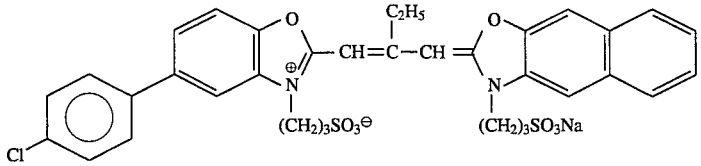
18)
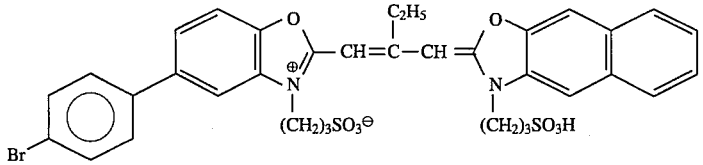
19)
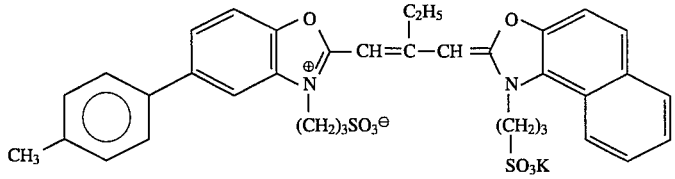
20)
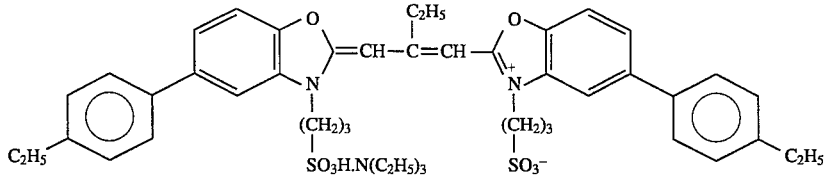

-continued
21)
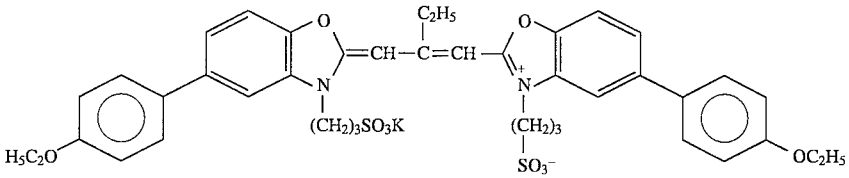
22)
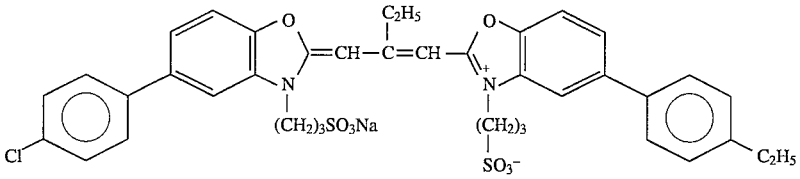
23)
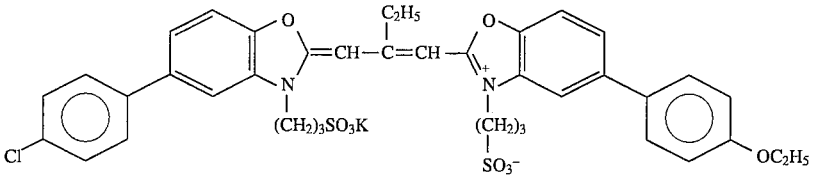
24)
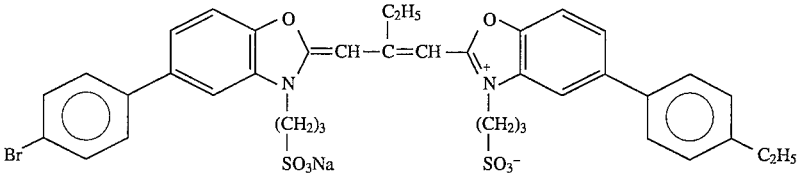
25)
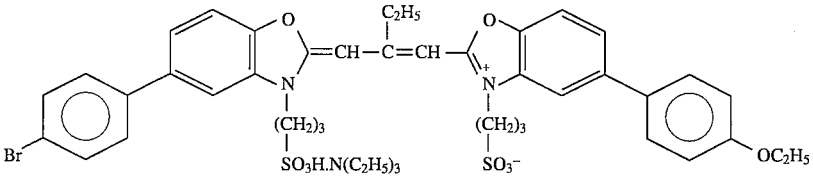
26)
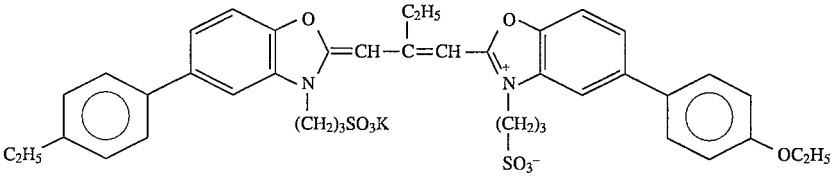
27)
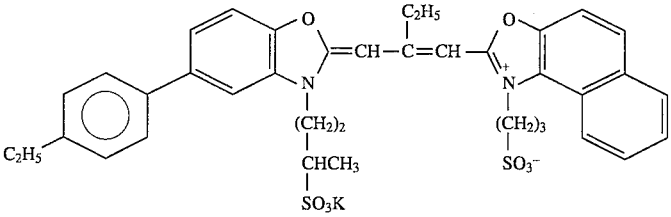
28)
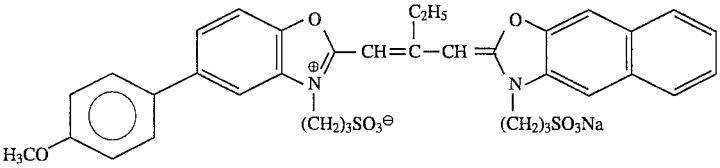
29)
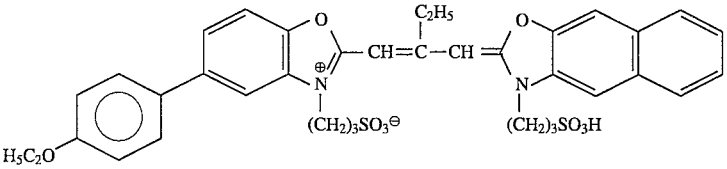

-continued
30)
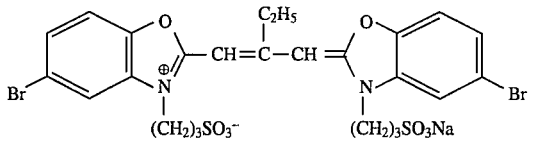
31)
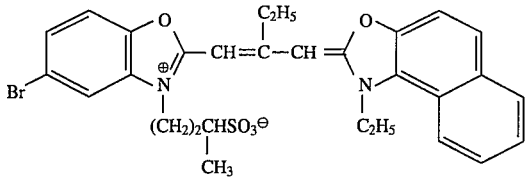
32)
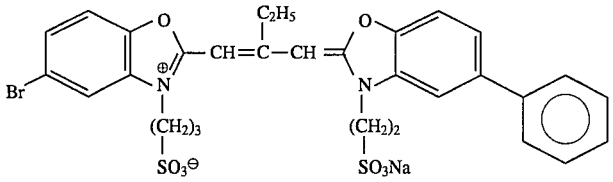
33)
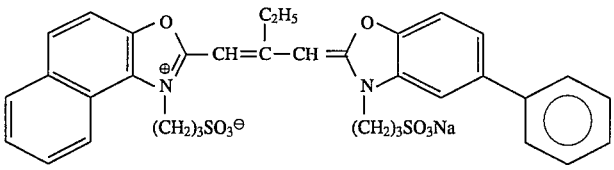
34)
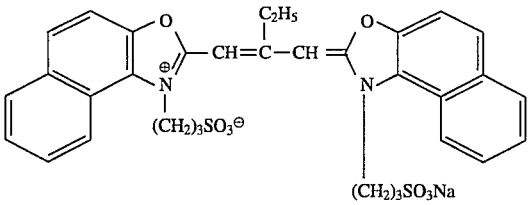
35)
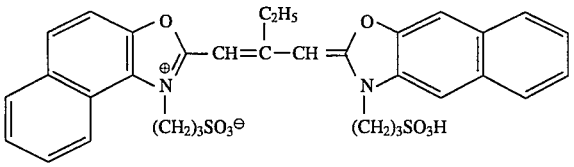
36)
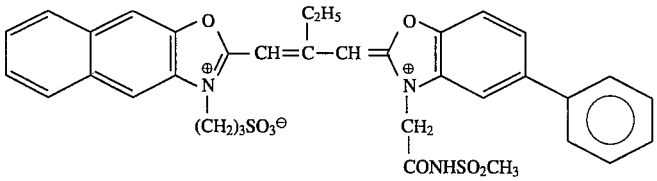
37)
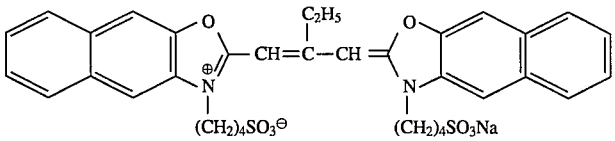
38)
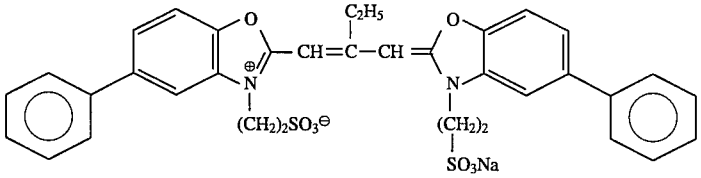

The emulsion of the present invention contains various additives mentioned above. In addition to these, the emulsion may contain other various additives in accordance with its object.

Additives that may be added to the emulsion of the present invention are described in detail in *Research Disclosure,* No. 17643 (December, 1978); ibid., No. 18716 (November, 1979); ibid., No. 308119 (December, 1989). The relevant parts in these are summarized in Table 1 mentioned hereinafter.

The photographic material of the present invention is not specifically defined, provided that it has at least one of blue-sensitive silver halide emulsion layer, green-sensitive silver halide emulsion layer and red-sensitive silver halide emulsion layer on a support. In the material, the number of the silver halide emulsion layers and light-insensitive layers as well as the order of the layers on the support is not specifically defined. As one typical example, there is mentioned a silver halide color photographic material having at least one light-sensitive layer composed of plural silver halide emulsion layers each having a substantially same spectral sensitivity but having a different sensitivity on a support. The light-sensitive layer is a unit light-sensitive layer having a spectral sensitivity to anyone of blue light, green light and red light. In such a multi-layer silver halide color photographic material, in general, the order of the light-sensitive layer units to be on the support comprises a red-sensitive layer unit, a green-sensitive layer unit and a blue-sensitive layer unit as formed on the support in this order. As the case may be, however, the order may be opposite to the above-mentioned one, in accordance with the object of the photographic material. As still another embodiment, a different spectrally sensitized layer may be sandwiched between other two and the same spectrally sensitized layers.

Various light-insensitive layers such as interlayer may be provided between the above-mentioned silver halide light-sensitive layers, or on or below the uppermost layer or lowermost layers.

Such an interlayer may contain various couplers and DIR compounds described in JP-A-61-43748, JP-A-59-113438, JP-A-59-113440, JP-A-61-20037 and JP-A-61-20038, and it may also contain conventional color stain preventing agents.

As the constitution of the plural silver halide emulsion layers of constituting the respective light-sensitive layer units, preferred is a two-layered constitution composed of a high-sensitivity emulsion layer and a low-sensitivity emulsion layer as described in West German Patent 1,121,470 and British Patent 923,045. In general, it is preferred that the plural light-sensitive layers are arranged on the support in such a way that the sensitivity of the layer is to gradually decrease in the direction to the support. In the embodiment, a light-insensitive layer may be provided between the plural silver halide emulsion layers. As another embodiment, a low-sensitivity emulsion layer is formed remote from the support and a high-sensitivity emulsion layer is formed near to the support, as so described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

As other examples, there are mentioned an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and JP-A-62-63936.

As further example, there is mentioned a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of the type, the sensitivity of each emulsion layer is gradually lowered to the direction of the support. Even in the three-layer constitution of the type, each of the same spectral sensitivity layers may be composed of three layers of middle-sensitivity emulsion layer/high-sensitivity emulsion layer/low-sensitivity emulsion layer as formed in this order from the remotest side from the support, as so described in JP-A-59-202464.

As still other examples of the layer constitution of the light-sensitive layer for use in the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer.

Where the light-sensitive layer for use in the present invention has four or more layers, the layer constitution thereof may be varied in accordance with the manner mentioned above.

As mentioned above, various layer constitutions and arrangements may be selected in accordance with the object of the photographic material of the present invention.

In the photographic material of the present invention, at least one silver halide emulsion layer formed on the support contains the particular silver halide emulsion of the present invention in an amount of 30% or more, preferably 50% or more, more preferably 70% or more.

The other silver halide grains, than the silver halide grains specifically defined by the present invention, to be in the photographic emulsions of constituting the photographic material of the present invention may be regular crystalline ones such as cubic, octahedral or tetradecahedral grains, or irregular crystalline ones such as spherical or tabular grains, or irregular crystalline ones having crystal defects such as twin planes, or composite crystalline ones composed of the above-mentioned regular and irregular crystalline forms.

Regarding the grain size of the other silver halide grains than the silver halide grains specifically defined by the present invention, the grains may be fine grains having a small grain size of about 0.2 microns or less or may be large ones having a large grain size of up to about 10 microns as the diameter of the projected area. The emulsion of the grains may be either a polydisperse emulsion or a monodisperse emulsion.

The silver halide emulsions to be used in carrying out the present invention are generally subjected to physical ripening, chemical ripening and spectral sensitization.

A method of adding chalcogen compounds to the emulsions during their preparation, such as that described in U.S. Pat. No. 3,772,031, is often advantageously employed in carrying out the present invention. In addition to S, Se and Te, cyan salts, thiocyan salts, selenocyanic acids, carbonates, phosphates and acetates may be used in such a method.

The silver halide grains for use in the present invention may be subjected to at least one of sulfur sensitization, selenium sensitization, gold sensitization, palladium sensitization, other noble metal sensitization and reduction sensitization, at any stage in the step of producing the emulsions of the grains. It is desirable to combine two or more of such sensitization methods. Depending on the stage at which the grains is subjected to such chemical sensitization, emulsions of different types can be produced. Such emulsions of different types include an emulsion of a type comprising silver halide grains having chemically-sensitized nuclei embedded into the depths of each grain, an emulsion of a type comprising silver halide grains having chemically-sensitized nuclei embedded into the shallow sites of the surface of each grain, and an emulsion of a type comprising silver halide grains having chemically-sensitized nuclei formed on the surface of each grain. In the emulsions of the present invention, the sites of each grain where the chemically-sensitized nuclei shall exist may be determined in accordance with the object. In general, it is most preferred to form at least one chemically-sensitized nucleus in the vicinity of the surface of each grain.

As one preferred embodiment of chemical sensitization in the present invention, mentioned is chalcogen sensitization or noble metal sensitization or a combination of these. To carry out such chemical sensitization, an active gelatin can be employed, as so described in T. H. James, The Theory of the Photographic Process, 4th Ed., MacMillan, (1977), pp. 67–76. A sensitizer of sulfur, selenium, tellurium, gold, platinum, palladium or iridium or a combination of these can be employed to carry out the chemical sensitization therewith at pAg of from 5 to 10, at pH of from 5 to 8 and at a temperature between 30° C. and 80° C., as so described in *Research Disclosure,* Vol. 120 (April, 1974), No. 12008; *Research Disclosure,* Vol. 134 (June, 1975), No. 13452; U.S. Pat. Nos. 2,642,361, 3,297,446, 3,772,031, 3,857,711, 3,901,714, 4,266,018, and 3,904,415; and British Patent 1,315,755. To carry out the noble metal sensitization, employable are salts of noble metals such as gold, platinum, palladium, iridium, etc. Of these, preferred is a combination of gold sensitization and palladium sensitization. To carry out the gold sensitization, employable are known compounds such as chloroauric acid, potassium chloroaurate, potassium auriothiocyanate, gold sulfide, gold selenide, etc. Palladium compounds employable in the palladium sensitization are salts of divalent or tetravalent palladium. As such palladium compounds, preferably employed are $R_2PdX_6$ or $R_2PdX_4$, in which R means a hydrogen atom, an alkali metal atom or an ammonium group, and X means a halogen atom such as a chlorine, bromine or iodine atom.

As specific examples of the compounds, preferred are $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. Thiocyanates or selenocyanates are preferably employed along with the gold compounds and the palladium compounds.

As sulfur sensitizing agents, usable are hypo (sodium thiocyanate), thiourea compounds, rhodanine compounds, as well as sulfur-containing compounds such as those described in U.S. Pat. Nos. 3,857,711, 4,266,018 and 4,054,457. The chemical sensitization can be carried out in the presence of a so-called chemical sensitization promoter. As the chemical sensitization promoter, usable are azaindenes, azapyridazines, azapyrimidines and the like others which can inhibit the emulsion from being fogged during the step of chemical sensitization and which can promote the sensitivity of the thus-sensitized emulsion. Examples of the chemical sensitization promoting modifier are described in U.S. Pat. Nos. 2,131,038, 3,411,914, and 3,554,757, JP-A-58-126526, and Duffin, Photographic Emulsion Chemistry, pp. 138–143.

The emulsion of the present invention is preferably subjected to both gold sensitization and sulfur sensitization. The amount of the gold sensitizing agent and that of the sulfur sensitizing agent to be used each is preferably from $1\times10^{-7}$ to $1\times10^{-4}$ mol, more preferably from $5\times10^{-7}$ to $1\times10^{-5}$ mol, per mol of the silver halide in the emulsion.

The emulsion of the present invention is also preferably sensitized by selenium sensitization. In the selenium sensitization, used are known unstable selenium compounds. Concretely, usable are colloidal metal selenium, and selenium compounds such as selenoureas (e.g., N,N-dimethylselenourea, N,N-diethylselenourea), selenoketones, selenoamides, etc. It is often preferred to combine the selenium sensitization with the above-mentioned sulfur sensitization and/or noble metal sensitization.

It is desirable that the silver halide emulsion of the present invention is subjected to reduction sensitization during the formation of the silver halide grains, or after the formation thereof and before, during or after the chemical sensitization thereof.

To carry out the reduction sensitization, employable is any of a method of adding a reduction-sensitizing agent to the silver halide emulsion, a silver-ripening method of growing or ripening the silver halide grains in a low-pAg atmosphere having pAg of from 1 to 7, and a high-pH ripening method of growing or ripening the silver halide grains in a high-pH atmosphere having pH of from 8 to 11. If desired, any two of these may be combined.

The method of adding a reduction-sensitizing agent is preferred since the level of reduction sensitization of the silver halide grains can be controlled delicately.

As the reduction-sensitizing agent, known are stannous salts, ascorbic acid and its derivatives, amines, polyamines, hydrazine derivatives, formamidinesulfinic acids, silane compounds, borane compounds, etc. To sensitize the emulsion of the present invention by reduction sensitization, any one or more of these known reduction-sensitizing agents can be selected and used. As preferred examples of the reduction-sensitizing agent for use in the present invention, mentioned are stannous chloride, thiourea dioxide, dimethylaminoborane, ascorbic acid and its derivatives. Since the amount of the reduction-sensitizing agent to be added depends on the conditions for producing the emulsion, it shall be appropriately determined. Suitably, however, it is from $10^{-7}$ to $10^{-3}$ mol per mol of the silver halide to be sensitized therewith.

The reduction-sensitizing agent is dissolved in water or a solvent such as alcohols, glycols, ketones, esters, amides, etc., and the resulting solution is added to the emulsion while the grains are growing therein. The agent may previously be added to the reactor where the emulsion is prepared, but it is preferred to add the agent to the emulsion at a suitable stage during the growth of the silver halide grains. It is also possible to previously add the reduction-sensitizing agent to an aqueous solution of a water-soluble silver salt or an aqueous solution of a water-soluble halide and these are used to produce the intended silver halide grains. It is also preferred that, with the progress of the growth of the grains, a solution of the reduction-sensitizing agent is added to the grains intermittently or continuously for a long period of time.

It is desirable that an oxidizing agent for silver is added to the emulsion during the process of producing it. The "oxidizing agent for silver" indicates a compound which acts on a metal silver to convert it into silver ion. In particular, compounds which can convert extremely fine silver grains that are produced as side products during the process of forming silver halide grains or during the process of chemically sensitizing them, into silver ions are effective. The silver ions to be produced by the reaction may form hardly water-soluble silver salts such as silver halides, silver sulfide, silver selenide, etc. or may form easily water-soluble silver salts such as silver nitrate, etc. The oxidizing agent for silver may be either an inorganic substance or an organic substance. As the inorganic oxidizing agent, for example, mentioned are ozone, hydrogen peroxide and its adducts (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), salts of peroxy acids (e.g., $K_2S_2O_8$, $K_2C_2O_6$, $K_2P_2O_8$), peroxy complexes (e.g., $K_2[Ti(O_2)C_2O_4].3H_2O$, $4K_2SO_4.Ti(O_2)OH.SO_4.2H_2O$, $Na_2[VO(O_2)(C_2H_4)_2].6H_2O$), salts of oxyacids such as permanganates (e.g., KMnO4 ) and chromates (e.g., $K_2Cr_2O_7$), halogen elements such as iodine or bromine, perhalogenates (e.g., potassium periodate), salts of high-valent metals (e.g., potassium hexacyanoferrate), thiosulfonates, etc.

As the organic oxidizing agent, for example, mentioned are quinones such as p-quinone, organic peroxides such as peracetic acid and perbenzoic acid, active halogen-releasing compounds (e.g., N-bromosuccinimide, chloramine T, chloramine B), etc.

Inorganic oxidizing agents such as ozone, hydrogen peroxide and its adducts, halogen elements and thiosulfonates, as well as organic oxidizing agents such as quinones are preferably used in the present invention. The above-mentioned reduction sensitization is combined with the oxidizing agent for silver as one preferred embodiment of the present invention. To carry out this, employable is any of a method of adding the oxidizing agent to the emulsion followed by subjecting the emulsion to reduction sensitization or vice versa and a method of adding the oxidizing agent thereto while the emulsion is being subjected to reduction sensitization. These methods can be conducted even during the formation of the silver halide grains or during the chemical sensitization of the grains.

The photographic emulsions for use in the present invention can contain various compounds, for the purpose of preventing fogging of photographic materials of containing them during manufacture, storage or processing of the materials or of stabilizing the photographic properties of the materials. For instance, they may contain various compounds known as antifoggants or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), etc.; mercaptopyrimidines; thioketo compounds such as oxazolinethiones; azaindenes such as triazaindenes, tetrazaindens (especially, 4-hydroxy-substituted (1,3,3a,7)tetrazaindenes), pentazaindenes, etc. As examples, those described in U.S. Pat. Nos. 3,954,474, and 3,982,947 and JP-B-52-28660 can be employed. Those described in JP-A-63-212932 are preferred. Such antifoggants and stabilizers can be added to the emulsions at any stage before, during or after formation of the silver halide grains, during the rinsing step, during dispersion of the rinsed grains, before, during or after chemical sensitization of the grains and before coating the emulsions, in accordance with the object. In addition to making them express their intrinsic anti-fogging and stabilizing effects by adding the antifoggants and stabilizers to the emulsions during their preparation, the antifoggants and stabilizers can be used for other various purposes, for example, for controlling the crystal habits of the grains being formed, for reducing the grain size of the grains, for reducing the solubility of the grains, for controlling the degree of chemical sensitization of the grains and for controlling the arrangement of dyes.

In the photographic material of the present invention, two or more emulsions which are different from one another in at least one characteristic of light-sensitive silver halide grains of constituting them, which is selected from the grain size, the grain size distribution, the halogen composition, the shape and the sensitivity of the grains, can be incorporated into one and the same layer.

Surface-fogged silver halide grains as described in U.S. Pat. No. 4,082,553; inside-fogged silver halide grains as described in U.S. Pat. No. 4,626,498 and JP-A-59-214852; as well as colloidal silver may preferably be used in the light-sensitive silver halide emulsion layers and/or the substantially light-insensitive hydrophilic colloid layers of constituting the photographic material of the present invention. Inside-fogged or surface-fogged silver halide grains are such grains that can be non-imagewise uniformly developed irrespective of the non-exposed area and the exposed area of the photographic material. A method of preparing such inside-fogged or surface-fogged silver halide grains is described in U.S. Pat. No. 4,626,498 and JP-A-59-214852.

The silver halide of forming the inside nucleus of an inside-fogged core/shell type silver halide grain may be either one having the same halogen composition or one having a different halogen composition. The inside-fogged or surface-fogged silver halide may be any of silver chloride, silver chlorobromide, silver iodobromide or silver chloroiodobromide. The grain size of such a fogged silver halide grain is not specifically defined, and it is preferably from 0.01 to 0.75 μm, especially preferably from 0.05 to 0.6 μm, as a mean grain size. The shape of the grain is not also specifically defined, and it may be either a regular grain or an irregular grain. The emulsion containing such fogged grains may be either a monodisperse one or a polydisperse one. Preferred is a monodisperse one, in which at least 95% by weight or by number of all the silver halide grains therein have a grain size to fall within the range of the mean grain size ±40%.

The photographic material of the present invention preferably contain light-insensitive fine silver halide grains. Light-insensitive fine silver halide grains are meant to be fine silver halide grains which are not sensitive to the light as imparted to the photographic material for imagewise exposure thereof and are substantially not developed in the step of development of the exposed material. These fine grains are desired not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains are desired to have a mean grain size (as a mean value of the circle-corresponding diameter of the projected area) of from 0.01 to 0.5 μm, more preferably from 0.02 to 0.2 μm.

The fine silver halide grains may be prepared by the same method as that of preparing ordinary light-sensitive silver halide grains. In the case, the surfaces of the fine silver halide grains to be prepared do not need to be optically sensitized and spectral sensitization of the grains is unnecessary. However, prior to addition of the fine grains to the coating composition, it is desired to previously add a known stabilizer, such as triazole compounds, azaindene compounds, benzothiazolium compounds or, mercapto compound or zinc compounds, to the coating composition. The fine silver halide grains-containing layer may preferably contain colloidal silver.

The amount of silver as coated in the photographic material of the present invention is preferably from 1.0 to 6.0 $g/m^2$, most preferably from 1.0 to 4.5 $g/m^2$.

Various known photographic additives which may be used in preparing the photographic materials of the present invention are mentioned in the above-mentioned three *Research Disclosures* (RD Nos. 17643, 18716 and 308119), and the related descriptions therein are shown in Table 1 mentioned hereinafter.

In order to prevent deterioration of the photographic property of the photographic material of the present invention by formaldehyde gas as imparted thereto, compounds capable of reacting with formaldehyde so as to solidify it, for example, those described in U.S. Pat. Nos. 4,411,987 and 4,435,503, are preferably incorporated into the material.

It is preferred to incorporate mercapto compounds described in U.S. Pat. Nos. 4,740,454 and 4,788,132 and JP-A-62-18539 and JP-A-1-283551 into the photographic materials of the present invention.

It is also preferred to incorporate, into the photographic materials of the present invention, compounds capable of releasing a foggant, a development accelerator, a silver halide solvent or a precursor thereof, irrespective of the amount of the developed silver as formed by development, which are described in JP-A-1-106052.

It is also preferred to incorporate, into the photographic materials of the present invention, dyes as dispersed by the method described in international Patent Laid-Open No. WO88/04794 and Published unexamined International Application No. 1-502912, or dyes as described in EP-A-317308, U.S. Pat. No. 4,420,555 and JP-A-1-259358.

Various color couplers can be incorporated into the photographic material of the present invention, and examples of usable color couplers are described in patent publications as referred to in the above-mentioned RD No. 17643, VII-C to G, and RD No. 307105, VII-C to G.

As yellow couplers, for example, those described in U.S. Pat. Nos. 3,933,501, 4,022,620, 4,326,024, 4,401,752, and 4,248,961, JP-B-58-10739, British Patents 1,425,020, and 1,476,760, U.S. Pat. Nos. 3,973,968, 4,314,023, and 4,511,649, and EP-A-249,473 are preferred.

As magenta couplers, 5-pyrazolone compounds and pyrazoloazole compounds are preferred. For instance, those described in U.S. Pat. Nos. 4,310,619, and 4,351,897, European Patent 73,636, U.S. Pat. Nos. 3,061,432, and 3,725,067, RD No. 24220 (June, 1984 ), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, and 4,556,630, and WO(PCT)88/04795 are preferred.

As cyan couplers, phenol couplers and naphthol couplers are preferred. For instance, those described in U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Publication (OLS) No. 3,329,729, EP-A-121365, EP-A-249453, U.S. Pat. Nos. 3,446,622, 4,333,999, 4,775,616, 4,451,559, 4,427,767, 4,690,889, 4,254,212, and 4,296,199, and JP-A-61-42658 are preferred.

Polymerized dye-forming couplers may also be used, and typical examples of such couplers are described in U.S. Pat. Nos. 3,451,820, 4,080,211, 4,367,282, 4,409,320, and 4,576,910, British Patent 2,102,137 and EP-A-341188.

Couplers capable of forming a colored dyes having a pertinent diffusibility may also be used, and those described in U.S. Pat. No. 4,366,237, British Patent 2,125,570, European Patent 96,570, and West German Patent Publication (OLS) No. 3,234,533 are preferred.

As colored couplers for correcting the unnecessary absorption of colored dyes, those described in RD No. 17643, VII-G, RD No. 307105, VII-G, U.S. Pat. No. 4,163,670, JP-B-57-39413, U.S. Pat. Nos. 4,004,929, and 4,138,258, and British Patent 1,146,368 are preferred. Additionally, couplers of correcting the unnecessary absorption of the colored dye by the phosphor dye to be released during coupling, as described in U.S. Pat. No 4,774,181, as well as couplers having a dye precursor group capable of reacting with a developing agent to form a dyes, as a split-off groups, as described in U.S. Pat. No. 4,777,120 are also preferably used.

Couplers capable of releasing a photographically useful residue along with coupling may also be used in the present invention. For instance, as DIR couplers of releasing a development inhibitor, those described in the patent publications as referred to in the above-mentioned RD No. 17643, Item VII-F, RD No. 307105, Item VII-F, as well as those described in JP-A-57-151944, JP-A-57-154234, JP-A-60-184248, JP-A-63-37346, JP-A-63-37350 and U.S. Pat. Nos. 4,248,962 and 4,782,012 are preferred.

As couplers of imagewise releasing a nucleating agent or development accelerator during development, those described in British Patents 2,097,140 and 2,131,188, JP-A-59-157638 and JP-A-59-170840 are preferred. In addition, compounds of releasing a foggant, a development accelerator or a silver halide solvent by redox reaction with an oxidation product of a developing agent, as described in JP-A-60-107029, JP-A-60-252340, JP-A-1-44940 and JP-A-1-45687, are also preferably used.

Additionally, as examples of compounds which may be incorporated into the photographic materials of the present invention, there are further mentioned competing couplers described in U.S. Pat. No. 4,130,427; poly-valent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers of releasing a dye which recolors after released from the coupler, as described in EP-A-173302 and EP-A-313308; bleaching accelerator-releasing couplers described in RD No. 11449, RD No. 24241, and JP-A-61-201247; ligand-releasing couplers described in U.S. Pat. No. 4,555,477; leuco dye-releasing couplers described in JP-A-63-75747; and couplers of releasing a phosphor dye as described in U.S. Pat. No. 4,774,181, etc.

The above-mentioned couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027.

As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl)sebacate, dioctyl azelate, glycerol tributylate, isostearyl lactate, trioctyl citrate), aniline derivatives (e.g., N,N-dibutyl-2-butoxy-5-tert-octylaniline), hydrocarbons paraffin, dodecylbenzene, diisopropylnaphthalene). As an auxiliary solvent, organic solvents having a boiling point of approximately from 30° to 160° C., preferably from 50° to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, West German Patent Publication (OLS) Nos. 2,541,274 and 2,541,230.

The photographic material of the present invention preferably contains an antiseptic or fungicide of various kinds, for example, selected from phenethyl alcohol and those described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 879.

It is desired that the total film thickness of all the hydrophilic colloid layers as provided on the surface of the support of having emulsion layers is 28 microns or less, preferably 23 microns or less, more preferably 18 microns or less, especially preferably 16 microns or less, in the photographic material of the present invention. It is also desired that the photographic material of the present invention has a film swelling rate (T ½) of 30 seconds or less, preferably 20 seconds or less. The film thickness as referred to herein is one as measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., Photographic Science And Engineering, Vol. 19, No. 2, pages 124 to 129. The film swelling rate (T ½) is defined as follows: 90% of the maximum swollen thickness of the photographic material as processed in a color developer under the condition of 30° C. and 3 minutes and 15 seconds is called a saturated swollen thickness. The time necessary for attaining a half (½) of the saturated swollen thickness is defined to be a film swelling rate (T ½).

The film swelling rate (T ½) can be adjusted by adding a hardening agent to gelatin of a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness—original film thickness)/(original film thickness).

It is preferred that the photographic material of the present invention has a hydrophilic colloid layer having a total dry thickness of from 2 μm to 20 μm on the side opposite to the side of having the emulsion layers. The layer is referred to as a backing layer. It is preferred that the backing layer contains various additives of the above-mentioned light absorbent, filter dye, ultraviolet absorbent, antistatic agent, hardening agent, binder, plasticizer, swelling agent, coating aid and surfactant. The backing layer is desired to have a swelling degree of from 150 to 500%.

Known photographic additives which can be used in the present invention are described in the above cited three *Research Disclosures,* and the related descriptions are shown in the following table in which the right column is indicated as "RC" and the left column is indicated as "LC".

| | Kind of Additives | RD 17643 | D 18716 | D 308119 |
|---|---|---|---|---|
| 1. | Chemical sensitizer | p. 23 | p. 648 RC | p. 996 |
| 2. | Sensitivity increasing agent | | p. 648 RC | |
| 3. | Spectral sensitizer and supersensitizer | pp. 23–24 | p. 648 RC-p. 649 RC | p. 996 RC-p. 998 RC |
| 4. | Brightening agent | p. 24 | p. 647 RC | p. 998 RC |
| 5. | Anti-foggant and stabilizer | pp. 24–25 | p. 649 RC | p. 998 RC-p. 1000 RC |
| 6. | Light absorbent, filter dye, and ultraviolet absorber | pp. 25–26 | p. 648 RC-p. 650 LC | p. 1003 LC-p. 1003 RC |
| 7. | Stain inhibitor | p. 25 RC | p. 650 LC-RC | p. 1002 RC |
| 8. | Dye image stabilizer | p. 25 | | p. 1002 RC |
| 9. | Hardening agent | p. 26 | p. 651 LC | p. 1004 RC-p. 1005 LC |
| 10. | Binder | p. 26 | p. 651 LC | p. 1003 RC-p. 1004 RC |
| 11. | Plasticizer and lubricant | p. 27 | p. 650 RC | p. 1006 LC-p. 1006 RC |
| 12. | Coating aid and surface active agent | pp. 26–27 | p. 650 RC | p. 1005 LC-p. 1006 LC |
| 13. | Antistatic agent | p. 27 | p. 650 RC | p. 1006 RC-p. 1007 LC |
| 14. | Matting agent | | | p. 1008 LC-p. 1009 LC |

The color photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution mainly containing an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, as well as sulfates, hydrochlorides and p-toluenesulfonates of the compounds. Above all, especially preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and their hydrochlorides, p-toluenesulfonates and sulfates. These compounds can be used in combination of two or more of them, in accordance with the object.

The amount of the aromatic primary amine developing agent in the color developer for use in the present invention is preferably from 0. 0002 mol to 0.2 mol, more preferably from 0. 001 mol to 0.1 mol, per liter of the developer.

The color developer generally contains a pH buffer such as alkali metal carbonates, borates, phosphates or 5-sulfosalicylates, and a development inhibitor or anti-foggant such as chlorides, bromides, iodides, benzimidazoles, benzothiazoles or mercapto compounds. If desired, it may also contain various preservatives such as hydroxylamine, diethylhydroxylamine and other hydroxylamines of formula (I) mentioned in JP-A-3-144446, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediaminetetraacetic acid, nitrilotriacetic acid, diethylenetriaminepentaacetic acid, cyctohexanediaminetetraacetic acid, hydroxylethyliminodiacetic acid, 1-hydroxyethylidene-1,1-diphosphonic acid, nitrilo-N,N,N-trimethylenephosphonic acid, ethylenediamine-N,N,N,N-tetramethytenephosphonic acid, ethylenediaminedi(o-hydroxyphenylacetic acid) and their salts.

Of those mentioned above, most preferred, as the preservatives, are substituted hydroxylamines. In particular, hydroxylamines having, as the substituents, alkyl groups substituted by water-soluble groups such as a sulfo group, a carboxyl group, a hydroxyl group, etc. are preferred. The most preferred examples of the preservatives are N,N-bis(2-sulfoethyl)hydroxylamine and its alkali metal salts.

As the chelating agents, preferred are biodegradable compounds. Examples of such compounds are described in JP-A-63-146998, JP-A-63-199295, JP-A-63-267750, JP-A-63-267751, JP-A-2-229146, JP-A-3-186841, German Patent 3,739,610 and European Patent 468,325.

It is desirable that the replenisher tank for the color developer as well as the tanks for the processing solutions to be used for processing the photographic material of the present invention are shielded with a liquid material such as high boiling point organic solvents, thereby reducing their areas to be kept in contact with air. As the liquid shield material, liquid paraffin is the most preferred. It is especially preferred to apply the liquid shield material to the replenisher tank.

The temperature at which the photographic material is processed with the color developer is preferably from 20° C. to 55° C., preferably from 30° C. to 55° C. The processing time is from 20 seconds to 5 minutes, preferably from 30 seconds to 3 minutes and 20 seconds, more preferably from 40 seconds to 2 minutes and 30 seconds for photographic materials for photographing, while it is from 10 seconds to 1 minute and 20 seconds, preferably from 10 seconds to 60 seconds, more preferably from 10 seconds to 40 seconds for photographic materials for printing.

Where the photographic material is processed for reversal finish, in general, it is first subjected to black-and-white development and then subjected to color development. For the first black-and-white development is used a black-and-white developer, which contains a conventional black-and-white developing agent, for example, dihydroxybenzenes such as hydroquinone, 3-pyrazolidones such as 1-phenyl-3-pyrazolidone, or aminophenols such as N-methyl-p-aminophenol, singly or in combination of them.

The color developer and the black-and-white developer generally has a pH value of from 9 to 12. The amount of the replenisher to the developer is, though depending upon the the color photographic material to be processed, generally 3 liters or less per $m^2$ of the photographic material to be processed. It may be reduced to 500 ml or less per $m^2$ of the photographic material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

Opening Ratio=(Contact Surface Area ($cm^2$) of Processing Solution with Air)/(Volume ($cm^3$) of Processing Tank)

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing method described in JP-A-63-216050. Reduction of the opening ratio is preferably applied to not only the both steps of color development and black-and-white development but also all the subsequent steps such as bleaching, bleach-fixation, fixation, washing and stabilization steps. In addition, the amount of the replenisher to be added may also be reduced by means of suppressing accumulation of bromide ions in the developer.

After color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of continuous two tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent preferably usable in the present invention include organic complexes of iron(III), such as complexes thereof with ethylenediaminetetraacetic acid, diethylenetriaminepentaacetic acid, cyclohexanediaminetetraacetic acid, methyliminodiacetic acid or glycol ether-diamine-tetraacetic acid, as well as ferric complexes of 1,3-propylenediaminetetraacetic acid such as those described in JP-A-4-121739, from page 4, right lower column to page 5, left upper column. In addition to these, also preferably usable are carbamoyl bleaching agents such as those described in JP-A-4-73647; heterocyclic bleaching agents such as those described in JP-A-4-174432; bleaching agents described in EP-A-520457, such as ferric complexes of N-(2-carboxyphenyl)iminodiacetic acid; bleaching agents described in JP-A-5-66527, such as ferric complexes of ethylenediamine-N-2-carboxyphenyl-N,N',N'-triacetic acid; bleaching agents described in EP-A-501479; bleaching agents described in JP-A-4-127145; and ferric aminopolycarboxylates and their salts such as those described in JP-A-3-144446, page 11.

Organic aminopolycarboxylato iron(III) complexes are especially useful both in a bleaching solution and in a bleach-fixing solution. The bleaching solution or bleach-fixing solution containing any of such aminopolycarboxylato iron(III) complexes generally has a pH value of from 4.0 to 8.0, but the solution may have a lower pH value for rapid processing.

It is desirable that the photographic material is bleached, immediately after color-developed. In a reversal process, however, compensation is generally conducted between the color development and the bleaching. Such compensation may be carried out in a bleaching accelerator bath. The compensation bath may contain an image stabilizer such as those mentioned hereinafter.

The desilvering bath to be employed in processing the photographic material of the present invention may contain, in addition to the bleaching agent, any of rehalogenating agents such as those described in the above-mentioned JP-A-3-144446, page 12, pH buffers and known additives, as well as aminopolycarboxylic acids, organic phosphonic acids, etc.

Various bleaching accelerators can be added to the bleaching bath and its pre-bath to be used for processing the photographic material of the present invention. As examples of usable bleaching accelerators, mentioned are mercapto or disulfido group-having compounds such as those described in U.S. Pat. No. 3,893,858, German Patent 1,290,821, British Patent 1,138,842, JP-A-53-95630, *Research Disclosure,* No. 17129 (July, 1978); thiazolidine derivatives such as those described in JP-A-50-140129; thiourea derivatives such as those described in U.S. Pat. No. 3,706,561; iodides such as those described in JP-A-58-16235; polyethylene oxides such as those described in German Patent 2,748,430; polyamine compounds such as those described in JP-B-45-8836, etc. In addition, compounds described in U.S. Pat. No. 4,552,834 are also preferred. These bleaching accelerators may also be added to the photographic material. These bleaching accelerators are especially effective for bleach-fixing of developed color photographic materials for photographing. As the bleaching accelerators, mercapto compounds such as those described in British Patent 1,138,842 and JP-A-2-190856 are especially preferred.

It is desirable that the bleaching solution and the bleach-fixing solution contain, in addition to the above-mentioned compounds, organic acids for the purpose of preventing bleaching stains. Especially preferred are organic acids having an acid dissociation constant (pKa) of from 2 to 5.5. In particular, dibasic acids are preferred. As preferred examples of such organic acids, mentioned are monobasic acids such as acetic acid, propionic acid, hydroxyacetic acid, etc.; and dibasic acids such as succinic acid, glutaric acid, maleic acid, fumaric acid, malonic acid, adipic acid, etc. Of these, most preferred are succinic acid, glutaric acid and maleic acid.

It is desirable that the total time for the desilvering step is shorter within the range not causing any desilvering failure. Preferably, the time is from 1 minute to 3 minutes, more preferably from 1 minute to 2 minutes. The processing temperature may be from 25° C. to 50° C., preferably from 35° C. to 45° C. Within the preferred temperature range, the desilvering speed is accelerated and the formation of stains in the processed material is effectively inhibited.

It is especially preferred that the processing solution having a bleaching capacity to be used for processing the photographic material of the present invention is aerated while being used to process the photographic material. This is because the processing capacity of the solution is kept extremely stable by the aeration. For carrying out the aeration, any means known in this technical field can be employed. For instance, air may be blown into the processing solution having a bleaching capacity or air may be introduced thereinto by the use of an ejector.

To blow air into the processing solution, it is desirable that air is blown and released thereinto via an air-blowing duct having fine pores. Such an air-blowing duct is widely used, for example, in an aeration tank for activation sludge process. For the aeration, the disclosures in Z-121, Using Process, C-41, 3rd Ed. (1982), BL-1 to BL-2 (issued by Eastman Kodak) may be referred to. It is desirable that the processing solution having a bleaching capacity is forcedly stirred when used for processing the photographic material. For the forced stirring, directly employable is the technique disclosed in JP-A-3-33847, page 8, from right upper column, line 6 to left lower column, line 2.

In the desilvering process, it is desired that the stirring of the processing solution during the process is promoted as much as possible. As examples of reinforced stirring means for forcedly stirring the photographic material during the desilvering step, there are mentioned a method of running a jet stream of the processing solution to the emulsion-coated surface of the photographic material, as described in JP-A-62-183460; a method of promoting the stirring effect by the use of a rotating means, as described in JP-A-62-183461; a method of moving the photographic material being processed in the processing bath while the emulsion-coated surface of the photographic material is brought into contact with a wiper blade as provided in the processing bath, whereby the processing solution as applied to the emulsion-coated surface of the photographic material is made turbulent and the stirring effect is promoted; and a method of increasing the total circulating amount of the processing solution. Such reinforced stirring means are effective to any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the photographic material would be elevated. The above-mentioned reinforced stirring means is more effective, when a bleaching accelerator is incorporated into the processing solution. Because of the means, therefore, the bleaching accelerating effect could remarkably be augmented, and the fixation preventing effect by the bleaching accelerator could be evaded.

The photographic material of the present invention can be processed with an automatic developing machine. It is desired that the automatic developing machine to be used for processing the photographic material of the present invention is equipped with a photographic material-conveying means as described in JP-A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of the reasons, the conveying means is especially effective for shortening the processing time in each processing step and for reducing the amount of the replenisher to each processing bath.

Using the processing solution having a bleaching capacity in processing the photographic material of the present invention, the overflow from the used solution is recovered and its composition is reformed by adding the necessary components thereto, and the thus-reformed solution is recycled. This mode is generally referred to as regeneration, which is advantageously employed in processing the photographic material of the present invention. For the details of the regeneration mode, the disclosures in Fuji Film Processing Manuals for Fuji Color Negative Films, CN-16 Processing Operation (Revised Edition, August 1990), pp. 39–40 (issued by Fuji Photo Film Co.) are referred to.

The kit for preparing the processing solution having a bleaching capacity may contain either liquid materials or powdery materials. Except ammonium salts, almost all the raw materials for the solution are powdery, as they absorb only a little water. Therefore, the preparation of powdery raw materials for the solution in the kit is easy.

The kit for regenerating the used solution in the manner as above preferably contains powdery materials in view of the reduction in the amount of the waste liquid to be drained off, since the powdery materials may directly be added to the used solution without using any excess water.

To regenerate the used processing solution having a bleaching capacity, the methods described in Bases of Photographic Engineering—Silver Salt Photography—(edited by the Photographic Association of Japan and published by Corona Co., 1979), etc. can be employed, in addition to the above-mentioned aeration method. For example, employable are electrolytic regeneration and chemical regeneration of bleaching solutions, the latter using bromic acid, chlorous acid, bromine, bromine precursors, persulfates, hydrogen peroxide, hydrogen peroxide combined with catalysts, bromous acid, ozone, etc.

In the former electrolytic regeneration of bleaching solutions, a cathode and an anode are put in the same bleaching bath; or a cathode cell and an anode cell are prepared to be separated from each other via a partition membrane therebetween and a used bleaching solution is regenerated in these cells; or a used bleaching solution is regenerated simultaneously with a used developer and/or a used fixing solution also using a partition membrane. The regeneration of the used fixing solution and the used bleach-fixing solution is conducted by electrolytic reduction of the silver ions accumulated in these bathes. In addition, it is also desirable to remove the halide ions accumulated in the processing bathes by the use of anion-exchange resins, in order to maintain the fixing capacity of the processing solutions.

To reduce the amount of water to be used for washing the processed photographic material, ion exchange or ultrafiltration may be employed. Especially preferably, ultrafiltration is employed.

The photographic material of the present invention is generally washed in water and/or stabilized, after being desilvered. The amount of the water to be used in the washing step can be set in a broad range, in accordance with the characteristic of the photographic material being processed (for example, depending upon the raw material components, such as the coupler and so on) or the use of the photographic material, as well as the temperature of the washing water, the number of the washing tanks (the number of the washing stages), the replenishment system of concurrent or countercurrent and other various kinds of conditions. Among these conditions, the relation between the number of the washing tanks and the amount of the washing water in a multi-stage countercurrent washing system can be obtained by the method described in Journal of the Society of Motion Picture and Television Engineers, Vol. 64, pages 248 to 253 (May, 1955). According to the multi-stage countercurrent system described in the above-mentioned reference, the amount of the washing water to be used can be reduced noticeably, but because of the prolongation of the residence time of the water in the washing tank, bacteria would propagate in the tank so that the floating substances generated by the propagation of bacteria would adhere to the surface of the photographic material as it was processed. Accordingly, the above system would often have a problem. In the practice of processing the photographic material of the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, Chemistry of Bactericidal and Fungicidal Agents (1986, by Sankyo Publishing Co., Japan), Bactericidal and Fungicidal Techniques to Microorganisms, edited by Association of Sanitary Technique, Japan (1982, by Kogyo Gijutsu-kai, Japan), and Encyclopeadia of Bactericidal and Fungicidal Agents, edited by Nippon Bactericide and Fungicide Association, Japan (1986), can also be used.

The pH value of the washing water to be used for processing the photographic material of the present invention is from 4 to 9, preferably from 5 to 8. The temperature of the washing water and the washing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being washed with water. For the stabilization, any known methods, for example, as described in JP-A-57-8543, JP-A-58-14834 and JP-A-60-220345, can be employed.

The stabilizing solution may contain compounds capable of stabilizing color images, for example, formalin, benzaldehydes (e.g., m-hydroxybenzaldehdye), formaldehyde-bisulfite adducts, hexamethylenetetramine and its derivatives, hexahydrotriazine and its derivatives, N-methylol compounds (e.g., dimethylolurea, N-methylolpyrazole), as well as organic acids, pH buffers, etc. The preferred amount of such compounds to be in the stabilizing solution is from 0.001 to 0.02 mols per liter of the solution. However, the concentration of free is formaldehyde in the stabilizing solution preferably lower, since the solution releases a smaller amount of formaldehyde gas therefrom. From these viewpoints, m-hydroxybenzaldehyde, hexamethylenetetramine, N-methylolazoles such as those described in JP-A-4-270344 (e.g., N-methylolpyrazole) and azolylmethylamines such as those described in JP-A-4-313753 (e.g., N,N'-bis(1,2,4-triazol-1-ylmethyl)piperazine) are preferred as the color image stabilizers. In particular, a combination of any of azoles such as those described in JP-A-4-359249 (corresponding to EP-A-519190), such as 1,2,4-triazole, and any of azolylmethylamines and their derivatives, such as 1,4-bis(1,2,4-triazol-1-ylmethyl)piperazine, is especially preferred, as this has high image stabilizability while having a low formaldehyde vapor pressure. In desired, it is also desirable that the stabilizing solution additionally contains any of ammonium compounds such as ammonium chloride and ammonium sulfate, compounds of Bi and Al metals, brightening agents, hardening agents, alkanolamines such as those described in U.S. Pat. No. 4,786,583, preservatives such as those for the above-mentioned fixing solution and bleach-fixing solution, and sulfinic acid compounds such as those described in JP-A-1-231051.

The washing water and the stabilizing solution may contain various surfactants for the purpose of preventing the drying unevenness of the processed photographic material due to the water drops existing thereon during drying. In particular, nonionic surfactants are preferred for this purpose. Of these, especially preferred are alkylphenol-ethylene oxide adducts. As the alkylphenol moiety therein, preferred are octylphenol, nonylphenol, dodecylphenol and dinonylphenol. The number of mols of the ethylene oxide to be added thereto is especially preferably from 8 to 14. In addition, silicone surfactants are also preferably employed, as having a high de-foaming effect.

It is desirable that the washing water and the stabilizing solution contains various chelating agents. As preferred examples of chelating agents to be therein, mentioned are aminopolycarboxylic acids such as ethylenediaminetetraacetic acid, diethylenetriaminepentaacetic acid, etc.; organic phosphonic acids such as 1-hydroxyethylidene-1,1-diphosphonic acid, N,N,N'-trimethylenephosphonic acid, diethylenetriamine-N,N,N',N'-tetramethylenephosphonic acid, etc.; and hydrolysates of maleic anhydride polymers such as those described in EP-A-345,172.

The overflow from the washing and/or stabilizing solutions because of addition of replenishers thereto may be recycled in the other steps such as the previous desilvering step.

Where the photographic material of the present invention is processed with an automatic developing machine system and the processing solutions as being used in the process are evaporated and thickened, it is desired to add a suitable amount of water, a compensating solution or a replenisher to these solutions so as to correct their concentrations. The means for the addition is not specifically defined. For example, preferably employable are the compensating methods described in JP-A-1-254959 and JP-A-1-254960, in which a monitor tank is disposed separately to the bleaching bath, the amount of water evaporated from the monitor tank is measured, the amount of water to be evaporated from the bleaching bath is calculated from the thus-measured amount, and water is added to the bleaching bath in an amount proportional to the thus-calculated amount; and the compensating methods described in JP-A-3-248155, JP-A-3-249644, JP-A-3-249645 and JP-A-3-249646, in which a liquid level sensor or an overflow sensor is used. Water to be used for compensating the evaporation loss of the processing solutions in these compensating methods may be city water. Preferably, however, it is deionized water or sterilized water which is preferably used in the above-mentioned washing step.

The photographic material of the present invention is processed with these processing solutions at 10° C. to 50° C. In general, the processing temperature falls within the range between 33° C. and 38° C. However, the temperature may be made higher so as to accelerate the processing itself or to shorten the processing time, or on the contrary, the temperature may be made lower so as to improve the quality of images formed and to improve the stability of the processing solutions used.

These processing solutions can be used to process two or more different photographic materials. For instance, color negative films and color papers can be processed with the same processing solutions so that the costs of the processors can be lowered and the processing steps can be simplified.

Next, the present invention will be explained in more detail by means of the following examples, which, however, are not intended to restrict the scope of the present invention.

EXAMPLE 1

Preparation of Emulsion (A): Cubic Silver Chlorobromide Emulsion (comparative sample):

1200 ml of an aqueous solution of gelatin (containing 28 g of gelatin, 4.0 g of NaCl, and 3.2 ml of N,N'-dimethylimidazoline-2-thione (aqueous 1% solution)) were put into a reactor and heated at 52° C., and 200.0 ml of an aqueous solution of $AgNO_3$ (containing 32.9 g of $AgNO_3$) and 200.0 ml of an aqueous solution of NaCl (containing 14.1 g of NaCl) were added thereto and mixed, while stirring, over a period of 24 minutes. After $4.2\times10^{-4}$ mols of a thiosulfonic acid compound were added thereto, 523.0 ml of an aqueous solution of $AgNO_3$ (containing 156.9 g of $AgNO_3$) and 523.0 ml of an aqueous solution of NaCl (containing 54.0 g of NaCl) were added thereto and mixed, while kept at 52° C., over a period of 26 minutes and 9 seconds. Subsequently, $1.3\times10^{-3}$ mol, as Ag, of an emulsion of fine AgBr grains mentioned below were added thereto, and the resulting mixture was ripened for 5 minutes. This was cooled to 35° C., and this was desalted and washed with water by an ordinary method.

The grains in the emulsion thus obtained had a mean sphere-corresponding diameter of 1.0 μm.

Preparation of Emulsion of Fine AgBr Grains:

1200 ml of an aqueous solution of gelatin (containing 24 g of gelatin having a mean molecular weight of 30,000—hereinafter referred to as "M3 gelatin"—and 0.09 g of KBr and having pH of 3.0) were put into a reactor. While these were stirred at 23° C., 240.0 ml of an aqueous solution of AgNO3 (containing 60.0 g of $AgNO_3$, 2.0 g of M3 gelatin and 1.0 ml of 1M $HNO_3$) and 240.0 ml of an aqueous solution of KBr (containing 42.0 g of KBr, 2.0 g of M3 gelatin and 1.0 ml of 1M KOH) were added thereto and mixed, both at a flow rate of 90 cc/min, by a double jet method over a period of 2 minutes and 40 seconds. After stirred for 30 seconds, the resulting mixture was adjusted at pH of 4.0 and pBr of 3.2.

The fine AgBr grains in the emulsion thus obtained had a mean sphere-corresponding diameter of 0.04 μm.

Preparation of Emulsion (B): Tabular Silver Iodobromide Emulsion (comparative sample):

Emulsion (B-1) mentioned below, which contained silver bromide corresponding to 164 g of $AgNO_3$, was added to 1950 cc of water and kept at 55° C., at pAg of 8.9 and pH of 5.0. Next, 126 cc of an aqueous solution of 0.32M KI were added thereto at a constant rate over a period of 5 minutes, and then 206 cc of an aqueous solution of 1.9M $AgNO_3$ and an aqueous solution of KBr were added thereto at pAg of 8.9 over a period of 36 minutes. Afterwards, this was desalted by conventional flocculation. The silver iodobromide grains in the emulsion thus obtained were tabular grains having a mean circle-corresponding diameter of 2.1 μm, a mean thickness of 0.30 μm and a mean aspect ratio of 7. The emulsion contained tabular grains having an aspect ratio of 4 or more in an amount of 80% or more of the total projected area of all the grains therein.

Preparation of Emulsion (B-1) (core emulsion for Emulsion (B)):

1200 cc of an aqueous solution containing 6.2 g of gelatin and 6.4 g of KBr were stirred at 60° C., while 8 cc of an aqueous solution of 1.9M $AgNO_3$ and 9.6 cc of an aqueous solution of 1.7M KBr were added thereto by a double jet method over a period of 45 seconds. 38 g of gelatin were added thereto, and the resulting mixture was heated up to 75° C. and ripened for 20 minutes in the presence of $NH_3$. After this was neutralized with $HNO_3$, 405 cc of an aqueous solution of 1.9M $AgNO_3$ and an aqueous solution of KBr were added thereto at pAg of 8.22, both at an accelerated flow rate (in such a way that the final flow rate might be 10 times the initial flow rate), over a period of 87 minutes. Afterwards, the emulsion thus formed was cooled to 35° C. and desalted by ordinary flocculation. The silver bromide grains in the emulsion thus obtained were tabular grains having a mean circle-corresponding diameter of 2.0 μm, a mean thickness of 0.25 μm and a mean aspect ratio of 8.

Preparation of Emulsion (C): Tabular Silver Chlorobromide Emulsion (sample of the invention):

1200 ml of an aqueous solution of gelatin (containing 18.0 g of gelatin and having pH of 4.3) were put into a reactor and heated at 45° C., and 12.0 ml of an aqueous solution of $AgNO_3$ (containing 2.40 g of $AgNO_3$) and 12.0 ml of an aqueous solution of NaCl (containing 0.83 g of NaCl) were added thereto and mixed, while stirring, both at a flow rate of 24 ml/min by a double jet method. After this was stirred for one minute, 19.0 ml of an aqueous solution of $AgNO_3$ (containing 0.38 g of $AgNO_3$) and 19.0 ml of an aqueous solution of KBr (containing 0.27 g of KBr) were added thereto and mixed, both at a flow rate of 30 ml/min by a double jet method. After this was stirred for one minute, 36.0 ml of an aqueous solution of $AgNO_3$ (containing 7.20 g of $AgNO_3$) and 36.0 ml of an aqueous solution of NaCl (containing 2.48 g of NaCl) were added thereto and mixed, both at a flow rate of 48 ml/min by a double jet method. Next, 20.0 ml of an aqueous solution of NaCl (containing 12.0 g of NaCl) were added thereto, and the resulting mixture was adjusted at pH of 4.8.

After this was ripened at 70° C. for 16 minutes, 0.997 mols, as Ag, of an emulsion of fine AgCl grains mentioned below were added thereto, and the resulting mixture was ripened for 35 minutes. In addition, $3.0\times10^{-3}$ mols, as Ag, of the same emulsion of fine AgBr grains as that used in preparing Emulsion (A) mentioned above were added thereto, and the resulting mixture was ripened for 6 minutes.

Next, the emulsion thus formed was cooled to 35° C. and washed with water by conventional flocculation. Then, an aqueous solution of gelatin was added thereto and heated at 40° C., and the emulsion was adjusted at pH of 6.4 and pCl of 2.8.

The tabular silver chlorobromide grains in the emulsion thus obtained had a mean circle-corresponding diameter of 2.1 μm, a mean thickness of 0.29 μm and an aspect ratio of 7.

Preparation of Emulsion of Fine AgCl Grains:

1200 ml of an aqueous solution of gelatin (containing 24 g of M3 gelatin and 0.5 g of NaCl and having pH of 3.0) were put into a reactor. While these were stirred at 23° C., 900.0 ml of an aqueous solution of $AgNO_3$ (containing 225.0 g of $AgNO_3$, 9.0 g of M3 gelatin and 2.3 ml of 1M $HNO_3$) and 900.0 ml of an aqueous solution of NaCl (containing 77.4 g of NaCl, 9.0 g of M3 gelatin and 2.3 ml of 1M KOH) were added thereto and mixed, both at a flow rate of 90 cc/min, by a double jet method over a period of 10 minutes. After stirred for 30 seconds, the resulting mixture was adjusted at pH of 4.0 and pCl of 1.7

The fine AgCl grains in the emulsion thus obtained had a mean sphere-corresponding diameter of 0.06 μm.

These Emulsions (A) to (C) were chemically ripened in the manner mentioned below, at 60° C. and at pH of 6.20 and pAg of 8.40. Subsequently, Samples 101 to 313 were prepared using dyes and emulsions shown in Table 2 below.

TABLE 2

| | (Sample No.) | | |
|---|---|---|---|
| Dye No. | Emulsion (A) | Emulsion (B) | Emulsion (C) |
| 1 | 101 (Comparative Example) | 201 (Comparative Example) | 301 (Present Invention) |
| 3 | 102 (Comparative Example) | 202 (Comparative Example) | 302 (Present Invention) |
| 4 | 103 (Comparative Example) | 203 (Comparative Example) | 303 (Present Invention) |
| 7 | 104 (Comparative Example) | 204 (Comparative Example) | 304 (Present Invention) |
| 9 | 105 (Comparative Example) | 205 (Comparative Example) | 305 (Present Invention) |
| 13 | 106 (Comparative Example) | 206 (Comparative Example) | 306 (Present Invention) |
| 15 | 107 (Comparative Example) | 207 (Comparative Example) | 307 (Present Invention) |
| 17 | 108 (Comparative Example) | 208 (Comparative Example) | 308 (Present Invention) |
| 22 | 109 (Comparative Example) | 209 (Comparative Example) | 309 (Present Invention) |
| 23 | 110 (Comparative Example) | 210 (Comparative Example) | 310 (Present Invention) |
| 38 | 111 (Comparative Example) | 211 (Comparative Example) | 311 (Present Invention) |
| 32 | 112 (Comparative Example) | 212 (Comparative Example) | 312 (Present Invention) |
| Comparative Dye | 113 (Comparative Example) | 213 (Comparative Example) | 313 (Comparative Example) |

Comparative Dye

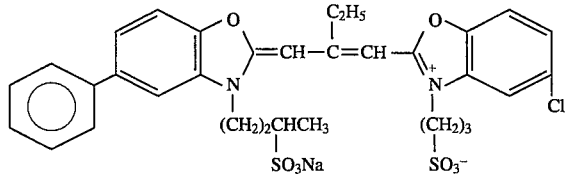

First, the sensitizing dye shown in Table 2 below was added to each of these Emulsions (A) to (C) in an amount corresponding to 80% of the saturated adsorption.

Subsequently, $3.0\times10^{-3}$ mol, per mol of silver, of potassium thiocyanate, $6\times10^{-6}$ mol, per mol of silver, of potassium chloroaurate, $1\times10^{-5}$ mol, per mol of silver, of sodium thiosulfate, and $3\times10^{-6}$ mol, per mol of silver halide, of a selenium sensitizing agent mentioned below were added to each of these emulsions, which were then ripened at 60° C. while varying the ripening time in such a way that each of the thus-ripened emulsions might have the maximum sensitivity when exposed for 1/100 second.

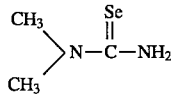

After the chemical sensitization, the compounds mentioned below were added to each emulsion. Each of the thus spectrally sensitized emulsions was coated on a triacetyl cellulose film support having thereon a subbing layer, along with a protective layer by co-extrusion, the amount of silver being 0.5 g/m$^2$. Thus, Samples Nos. 101 to 313 were prepared.

(1) Emulsion Layer:

Emulsion (spectrally sensitized emulsion mentioned above)

Compound (1) having a structural formula mentioned below.

Tricresyl phosphate

Stabilizer (4-hydroxy-6-methyl-1,3,3a , 7-tetrazaindene)

Coating aid (sodium dodecylbenzenesulfonate)

(2) Protective Layer:

Fine grains of polymethyl methacrylate 2,4-Dichloro-6-hydroxy-s-triazine sodium salt Gelatin

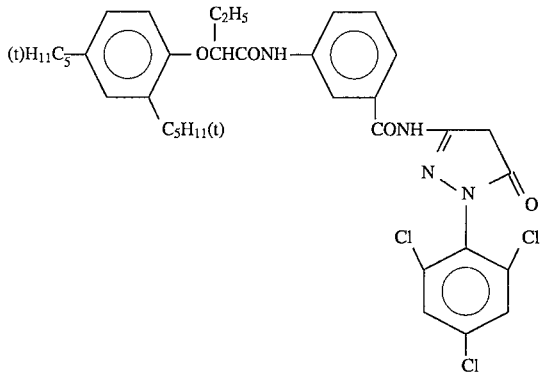

These samples were sensitometrically exposed for 1/100 second and then rapidly processed according to the color development process mentioned below.

Color Development Process:

| Step | Time | Temperature |
|---|---|---|
| Color Development | 45 sec | 38° C. |
| Bleaching | 30 sec | 38° C. |
| Fixation | 45 sec | 38° C. |
| Stabilization (1) | 20 sec | 38° C. |
| Stabilization (2) | 20 sec | 38° C. |
| Stabilization (3) | 20 sec | 38° C. |
| Drying | 30 sec | 60° C. |

*Stabilization was effected by countercurrent cascading from (3) to (1).

The compositions of the processing solutions used in the above-mentioned process are mentioned below.

| Color Developer: | |
|---|---|
| Ethylenediaminetetraacetic Acid | 3.0 g |
| Disodium 4,5-Dihydroxybenzene-1,3-disulfonate | 0.3 g |
| Potassium Carbonate | 30.0 g |
| Sodium Chloride | 5.0 g |
| Disodium N,N-bis(sulfonatoethyl)hydroxylamine | 6.0 g |
| 4-[N-ethyl-N-(β-hydroxyethyl)amino]-2-methyl-aniline Sulfate | 5.0 g |
| Water to make | 1.0 liter |
| pH (adjusted with potassium hydroxide and sulfuric acid) | 10.00 |
| **Bleaching Solution:** | |
| Ammonium 1,3-Diaminopropanetetraacetato Ferrate Monohydrate | 140 g |
| 1,3-Diaminopropanetetraacetic Acid | 3 g |
| Ammonium Bromide | 80 g |
| Ammonium Nitrate | 15 g |
| Hydroxyacetic Acid | 25 g |
| Acetic Acid (98%) | 40 g |
| Water to make | 1.0 liter |
| pH (adjusted with aqueous ammonia and acetic acid) | 4.3 |
| **Fixing Solution:** | |
| Disodium Ethylenediaminetetraacetate | 15 g |
| Ammonium Sulfite | 19 g |
| Imidazole | 15 g |
| Ammonium Thiosulfate (70 wt. %) | 280 ml |
| Water to make | 1.0 liter |
| pH (adjusted with aqueous ammonia and acetic acid) | 7.4 |
| **Stabilizing Solution:** | |
| Sodium p-Toluenesulfinate | 0.03 g |
| Polyoxyethylene p-Monononylphenyl Ether (mean degree of polymerization) | 0.2 g |
| Disodium Ethylenediaminetetraacetate | 0.05 g |
| 1,2,4-Triazole | 1.3 g |
| 1,4-Bis(1,2,4-triazol-1-ylmethyl)piperazine | 0.75 g |
| Water to make | 1.0 liter |
| pH (adjusted with aqueous ammonia and acetic acid) | 8.5 |

The density of each of the processed samples was measured through a green filter.

The sensitivity of each sample was defined to be the reciprocal of the amount of exposure giving a density of (fog+0.1) and was represented as a relative value based on the value (100) of Sample No. 101. The sensitivity of each sample thus measured is shown in Table 3 below.

From Table 3, it is known that the sensitivity of the emulsions of the present invention is high.

TABLE 3

(Sensitivity)

| Dye | Emulsion (A) | Emulsion (B) | Emulsion (C) |
|---|---|---|---|
| 1 | 100 | 140 | 300 |
| 3 | 105 | 140 | 295 |
| 4 | 100 | 135 | 295 |
| 7 | 100 | 140 | 290 |
| 9 | 105 | 140 | 290 |
| 13 | 105 | 145 | 305 |
| 15 | 105 | 145 | 295 |
| 17 | 95 | 135 | 300 |
| 22 | 100 | 140 | 295 |
| 23 | 100 | 140 | 290 |
| 38 | 95 | 140 | 220 |
| 32 | 90 | 135 | 180 |
| Comparative Dye | 80 | 135 | 110 |

EXAMPLE 2

Plural layers each having the composition mentioned below were coated on a subbing layer-coated cellulose triacetate support, to prepare a multi-layer color photographic material.

Compositions of Photographic Layers:

Essential components of constituting the photographic layers are grouped as follows:

ExC: Cyan Coupler

ExM: Magenta Coupler

ExY Yellow Coupler

ExS: Sensitizing Dye

UV: Ultraviolet Absorbent

HBS: High Boiling Point Organic Solvent

H: Gelatin Hardening Agent

The amounts of the components coated each is represented by g/m$^2$. The amount of the silver halide coated is represented by the amount of silver therein. The amount of the sensitizing dye coated is represented by the molar amount per mol of the silver halide in the same layer. Sample 400:

| First Layer: Anti-halation Layer | |
|---|---|
| Black Colloidal Silver | 0.09 as Ag |
| Gelatin | 1.30 |
| ExM-1 | 0.12 |
| ExF-1 | $2.0 \times 10^{-3}$ |
| Solid Dispersed Dye ExF-2 | 0.030 |
| Solid Dispersed Dye ExF-3 | 0.040 |
| HBS-1 | 0.15 |
| HBS-2 | 0.02 |
| **Second Layer: Interlayer** | |
| ExC-2 | 0.04 |
| Polyethyl Acrylate Latex | 0.20 |
| Gelatin | 1.04 |
| **Third Layer: Low-sensitivity Red-sensitive Emulsion Layer** | |
| Silver Chlorobromide Emulsion A | 0.25 as Ag |
| Silver Chlorobromide Emulsion B | 0.25 as Ag |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| **Fourth Layer: middle-sensitivity Red-sensitive Emulsion Layer** | |
| Silver Chlorobromide Emulsion C | 0.70 as Ag |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| **Fifth Layer: High-sensitivity Red-sensitive Emulsion Layer** | |
| Silver Chlorobromide Emulsion D | 1.40 as Ag |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| **Sixth Layer: Interlayer** | |
| Cpd-1 | 0.090 |
| Solid Dispersed Dye ExF-4 | 0.030 |
| HBS-1 | 0.050 |
| Polyethyl Acrylate Latex | 0.15 |
| Gelatin | 1.10 |
| **Seventh Layer: Low-sensitivity Green-sensitive Emulsion Layer** | |
| Silver Chlorobromide Emulsion E | 0.15 as Ag |
| Silver Chlorobromide Emulsion F | 0.10 as Ag |
| Silver Chlorobromide Emulsion G | 0.10 as Ag |
| ExS-4 | $3.0 \times 10^{-5}$ |
| ExS-5 | $2.1 \times 10^{-4}$ |

-continued

| | |
|---|---|
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| **Eighth Layer: Middle-sensitivity Green-sensitive Emulsion** | |
| Silver Chlorobromide Emulsion H | 0.80 as Ag |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.88 |
| **Ninth Layer: High-sensitivity Green-sensitive Emulsion Layer** | |
| Silver Chlorobromide Emulsion X (prepared in Example 1) | 1.25 as Ag |
| ExS-4 | $3.7 \times 10^{-5}$ |
| ExS-5 | $8.1 \times 10^{-5}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 |
| Gelatin | 1.00 |
| **Tenth Layer: Yellow Filter Layer** | |
| Yellow Colloidal Silver | 0.015 as Ag |
| Cpd-1 | 0.16 |
| Solid Dispersed Dye ExF-5 | 0.060 |
| Solid Dispersed Dye ExF-6 | 0.060 |
| Oil-soluble Dye ExF-7 | 0.010 |
| HBS-1 | 0.60 |
| Gelatin | 0.70 |
| **Eleventh Layer: Low-sensitivity Blue-sensitive Emulsion Layer** | |
| Silver Chlorobromide Emulsion I | 0.09 as Ag |
| Silver Chlorobromide Emulsion J | 0.09 as Ag |
| ExS-7 | $8.6 \times 10^{-4}$ |
| ExC-8 | $7.0 \times 10^{-3}$ |
| ExY-1 | 0.050 |
| ExY-2 | 0.73 |
| ExY-4 | 0.020 |
| Cpd-2 | 0.10 |
| Cpd-3 | $4.0 \times 10^{-3}$ |
| HBS-1 | 0.32 |
| Gelatin | 1.20 |
| **Twelfth Layer: High-sensitivity Blue-sensitive Emulsion Layer** | |
| Silver Chlorobromide Emulsion K | 1.00 as Ag |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| **Thirteenth Layer: First Protective Layer** | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |

-continued

| | |
|---|---|
| Gelatin | 1.2 |
| Fourteenth Layer: Second Protective Layer | |
| Silver Chloride Emulsion L | 0.10 as Ag |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

In addition, the respective layers contained any of W-1 to W-3, B-4 to B-6, F-1 to F-17, as well as an iron salt, a lead salt, a gold salt, a platinum salt, a palladium salt, an iridium salt and a rhodium salt, so as to have improved storability, processability, pressure resistance, fungicidal and bactericidal property, antistatic property and coatability.

The emulsions used above are shown in Table 4 below.

TABLE 4

| | Structure of Grains | AgCl Content (mol %) | AgBr Localized on Surfaces of Grains (mol %) | Mean Grain Size (as sphere-corresponding diameter) (μm) | Mean Aspect Ratio | Diameter (as circle-corresponding diameter of projected area) (μm) | Fluctuation Coefficient of Grain Size Distribution (%) |
|---|---|---|---|---|---|---|---|
| Emulsion A | rectangular parallelogrammic, tabular grains | 99.2 | 0.8 | 0.46 | 5.5 | 0.56 | 15 |
| Emulsion B | rectangular parallelogrammic, tabular grains | 99.2 | 0.8 | 0.57 | 4.0 | 0.78 | 20 |
| Emulsion C | rectangular parallelogrammic, tabular grains | 99.3 | 0.7 | 0.66 | 5.8 | 0.87 | 25 |
| Emulsion D | rectangular parallelogrammic, tabular grains | 99.5 | 0.5 | 0.84 | 3.7 | 1.03 | 26 |
| Emulsion E | rectangular parallelogrammic, tabular grains | 99.2 | 0.8 | 0.46 | 5.5 | 0.56 | 15 |
| Emulsion F | rectangular parallelogrammic, tabular grains | 99.3 | 0.7 | 0.57 | 4.0 | 0.78 | 20 |
| Emulsion G | rectangular parallelogrammic, tabular grains | 99.2 | 0.8 | 0.61 | 4.4 | 0.77 | 23 |
| Emulsion H | rectangular parallelogrammic, tabular grains | 99.2 | 0.8 | 0.61 | 4.4 | 0.77 | 23 |
| Emulsion I | rectangular parallelogrammic, tabular grains | 99.2 | 0.2 | 0.46 | 4.2 | 0.5 | 15 |
| Emulsion J | rectangular parallelogrammic, tabular grains | 99.3 | 0.7 | 0.64 | 5.2 | 0.85 | 23 |
| Emulsion K | rectangular parallelogrammic, tabular grains | 99.6 | 0.4 | 1.28 | 3.5 | 1.46 | 26 |
| Emulsion L | cubic grains | 100.0 | 0.0 | 0.07 | 1.0 | | 15 |

In Table 4 above;

(1) Emulsions I and J were subjected to reduction sensitization with thiourea dioxide and thiosulfonic acid during formation of the grains, in accordance with the example in JP-A-2-191938;

(2) Emulsions A to H were subjected to gold sensitization, sulfur sensitization and selenium sensitization in the presence of the spectral sensitizing dyes in the respective layers and sodium thiocyanate, in accordance with the example in JP-A-3-237450;

(3) the tabular grains were prepared in accordance with the example in U. S. Pat. No. 5,264,337.

Preparation of Dispersions of Organic, Solid Dispersed Dyes:

A dispersion of ExF-2 was prepared in the manner mentioned below. Precisely, 21.7 ml of water, 3 ml of an aqueous solution of 5% of sodium p-octylphenoxyethoxyethoxyethanesulfonate and 0.5 g of an aqueous solution of 5% of p-octylphenoxypolyoxyethylene ether (degree of polymerization: 10) were put into a 700-ml pot mill, 5.0 g of dye ExF-2 and 500 ml of zirconium oxide beads (diameter: 1 mm) were added thereto, and the content was dispersed for 2 hours. To disperse this, used was a BO-type shaking ball mill produced by Chuoh Kohki KK. After the dispersion, the content was taken out from the mill and added to 8 g of an aqueous solution of 12.5% of gelatin. The beads were removed by filtration. Thus, a gelatin dispersion of the dye was obtained. The fine dye grains had a mean grain size of 0.44 μm.

In the same manner as above, solid dispersions of ExF-3, ExF-4 and ExF-6 were prepared separately. The fine dye grains of ExF-3, ExF-4 and ExF-6 had a mean grain size of 0.24 μm, 0.45 μm and 0.52 μm, respectively. ExF-5 was dispersed by microprecipitation, according to the method in Example 1 in EP-A-549489. The fine dye grains of ExF-5 had a mean grain size of 0.06 μm.

Structural formulae or names of the compounds used above are shown below.

ExC-1
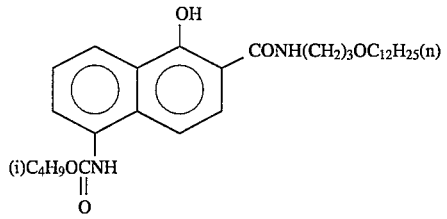
ExC-2
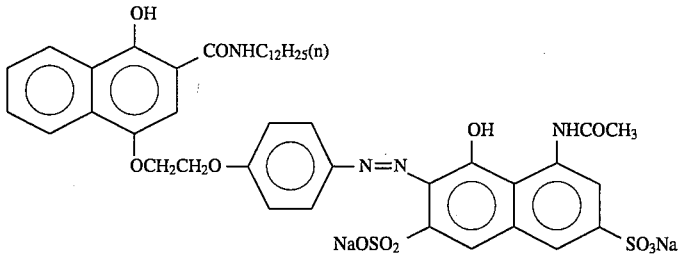
ExC-3
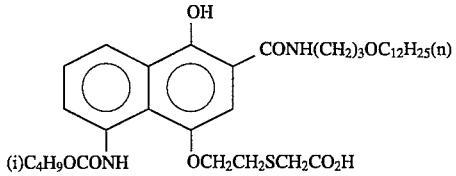
ExC-4
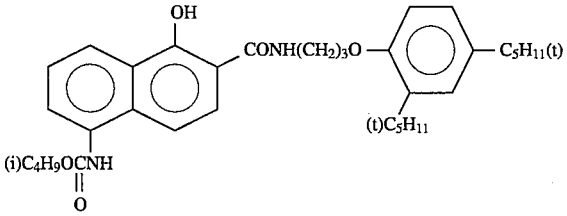
ExC-5
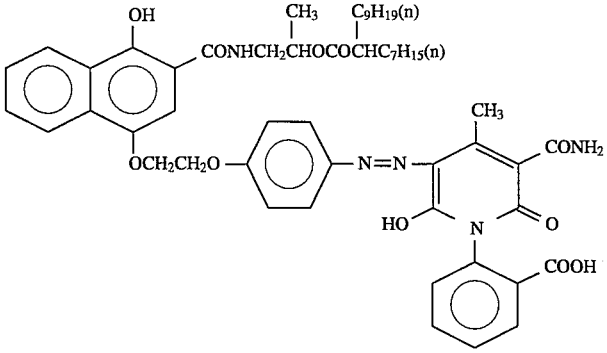
ExC-6
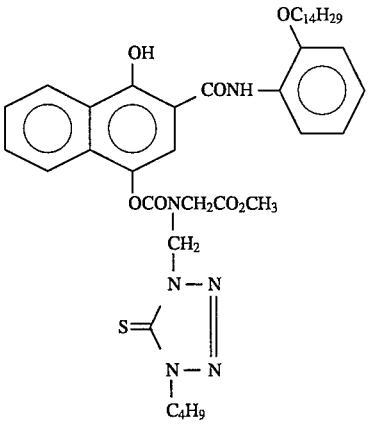
ExC-7
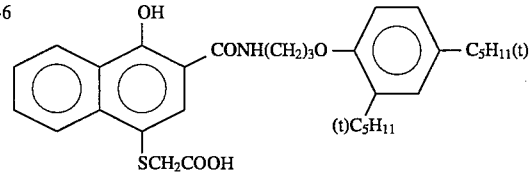

-continued
ExC-8
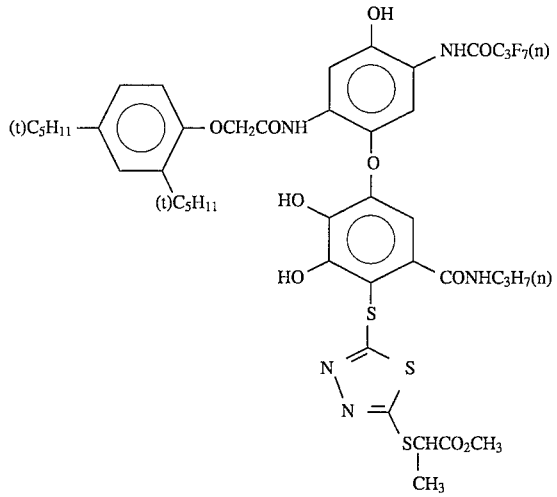
ExM-1
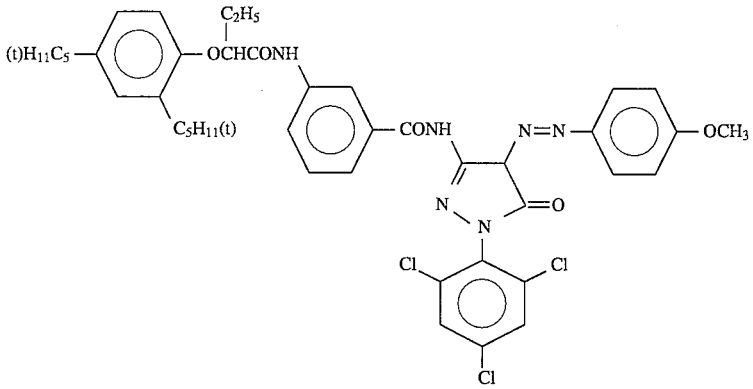
ExM-2
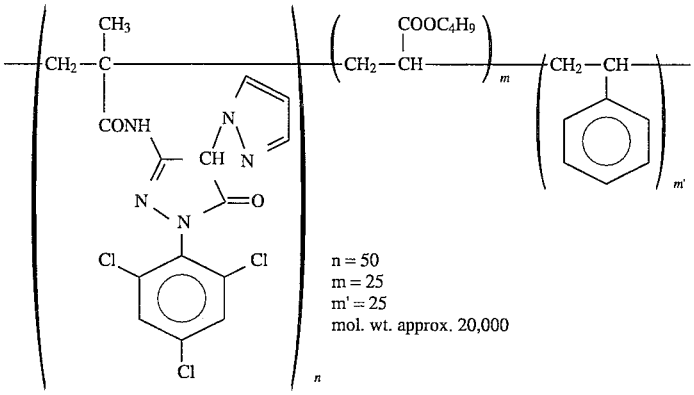
ExM-3
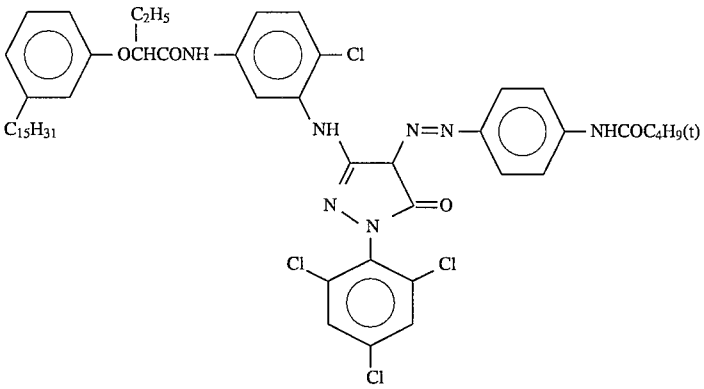

-continued
ExM-4
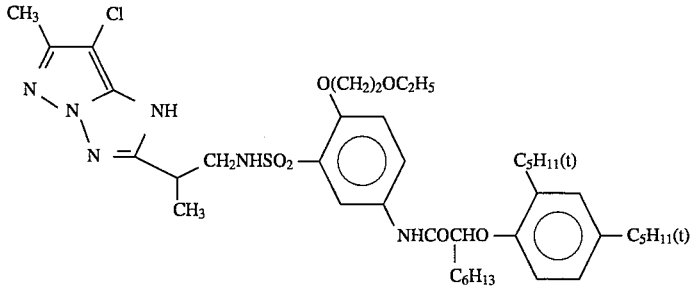
ExM-5
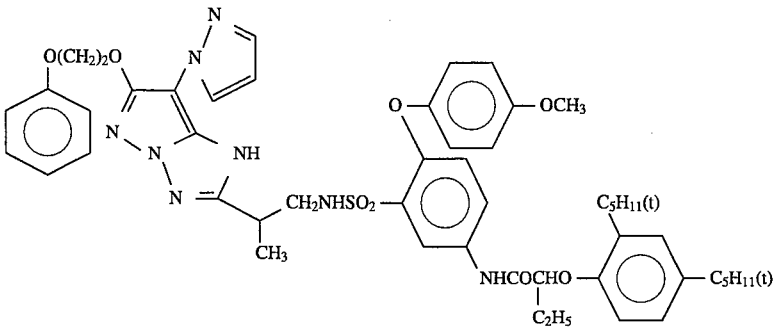
ExY-1
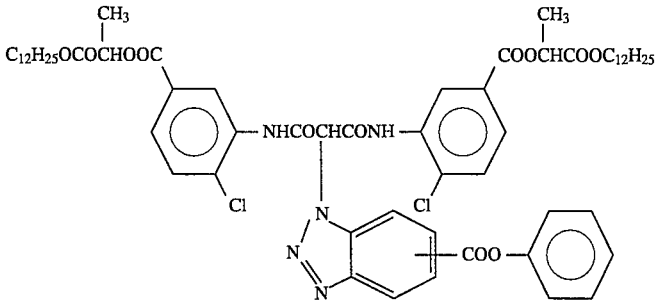
ExY-2
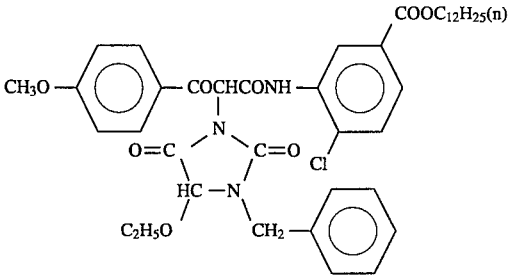
ExY-3
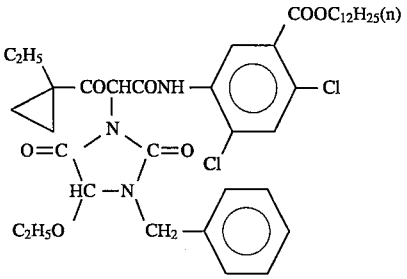
ExY-4
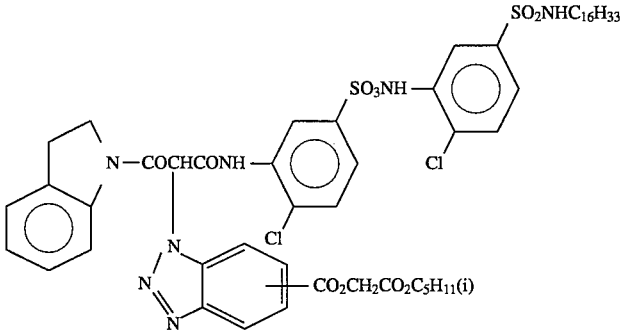

-continued
ExY-5
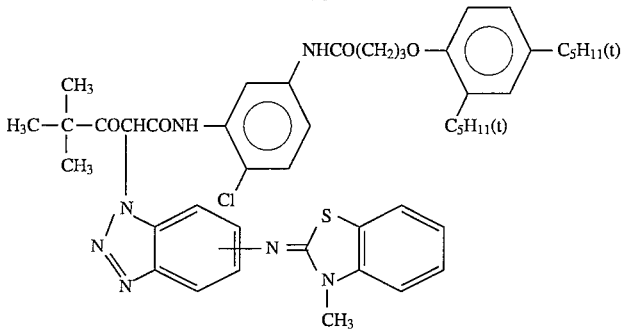
ExF-1
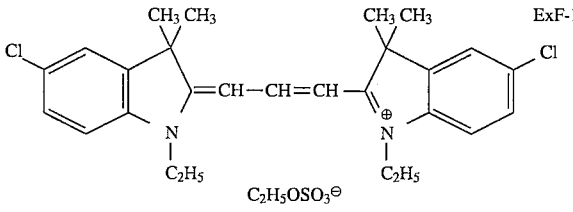
ExF-2
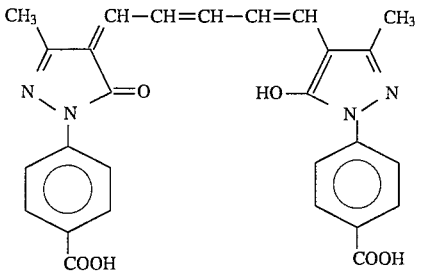
ExF-3
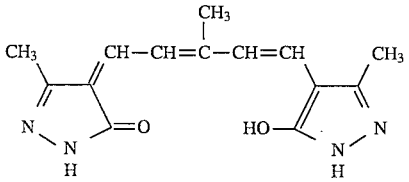
ExF-4
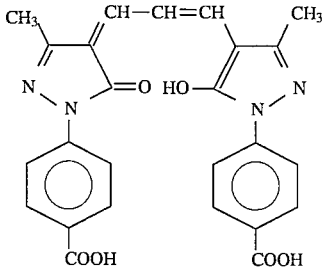
ExF-5
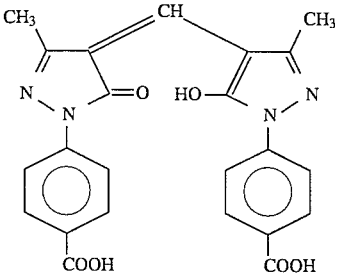
ExF-6
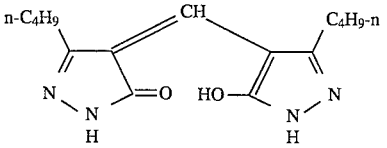
ExF-7
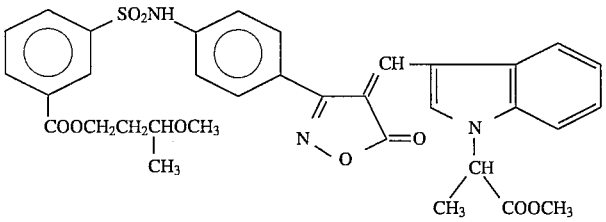
Cpd-1
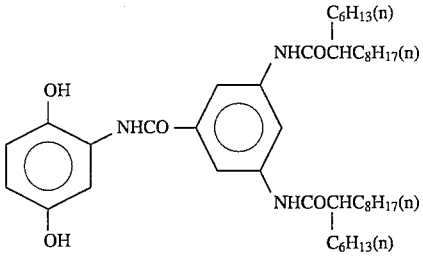
Cpd-2
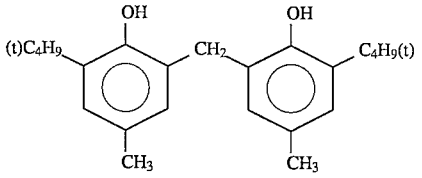

-continued
Cpd-3
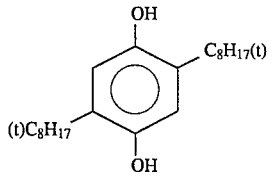
UV-1
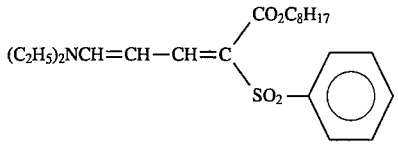
UV-2
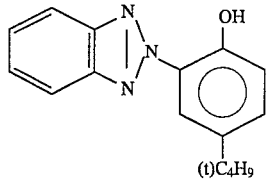
UV-3
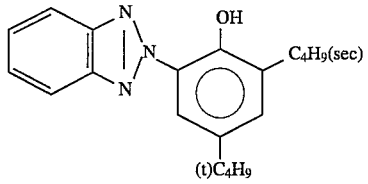
Tricresyl phosphate HBS-1
Di-n-butyl phthalate HBS-2
HBS-3
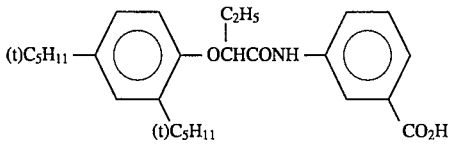
Tri(2-ethylhexyl) phosphate HBS-4
ExS-1
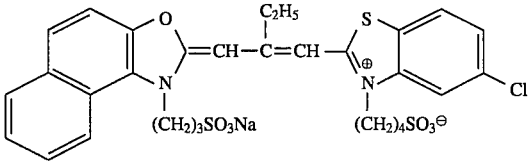
ExS-2
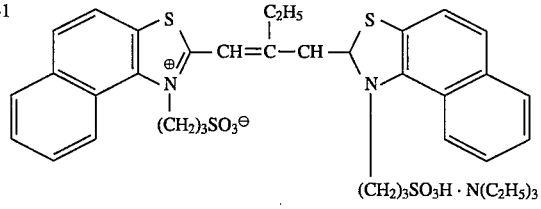
ExS-3
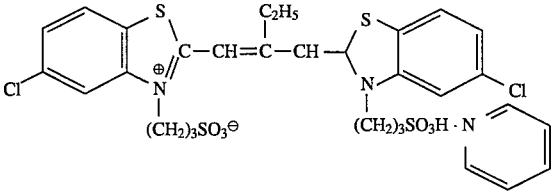
ExS-4
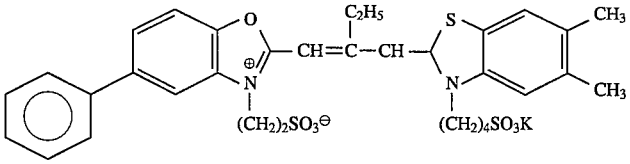
ExS-5
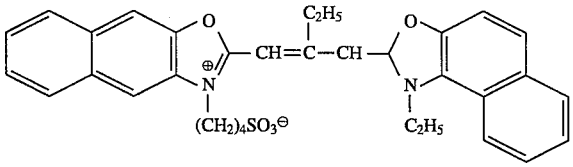
ExS-6
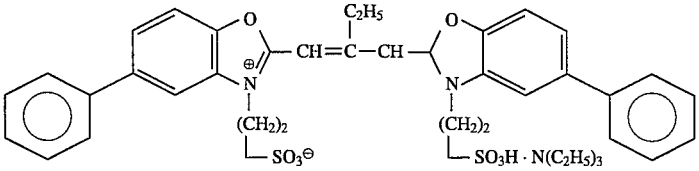
ExS-7
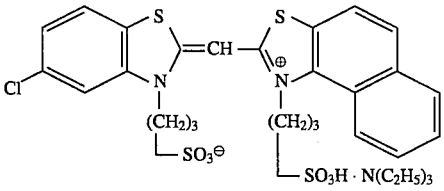
S-1
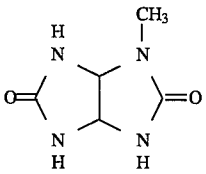

-continued
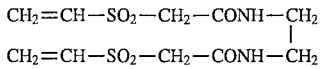
H-1
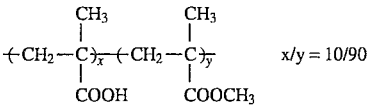
x/y = 10/90
B-1
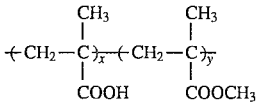
x/y = 40/60
B-2
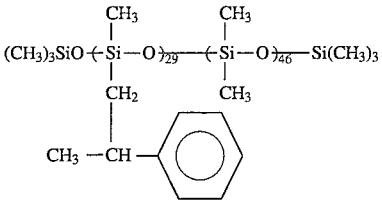
B-3
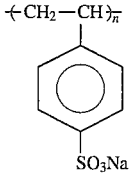
B-4
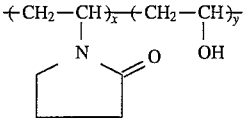
x/y = 70/30
B-5
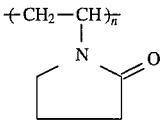
(mol. wt. approx. 10,000)
B-6
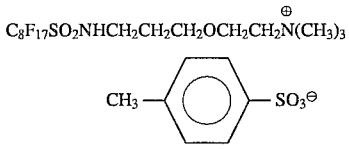
W-1
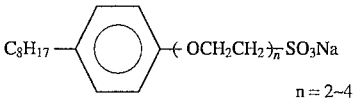
n = 2~4
W-2
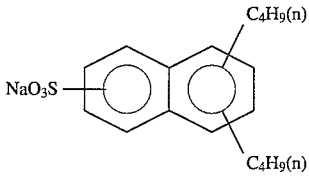
W-3
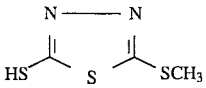
F-1
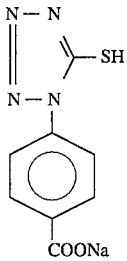
F-2
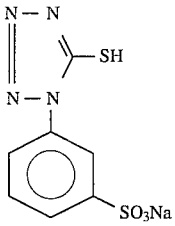
F-3
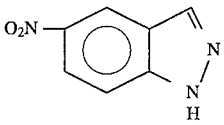
F-4
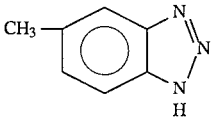
F-5
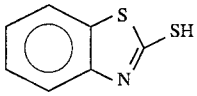
F-6

-continued

F-7

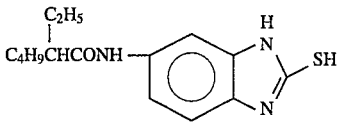

F-8

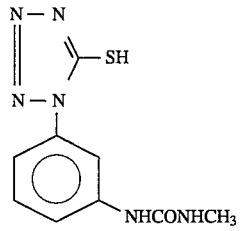

F-9

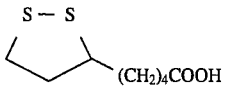

F-10

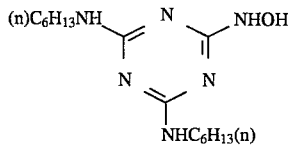

F-11

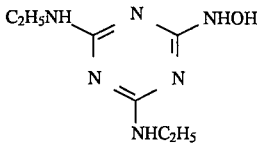

F-12

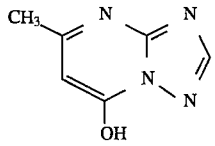

F-13

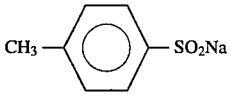

F-14

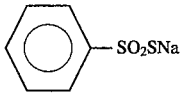

F-15

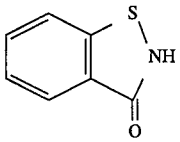

F-16

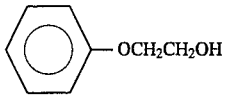

F-17

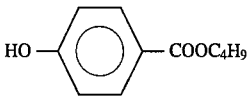

In the same manner as in preparation of Sample No. 400, Samples Nos. 401 to 613 were prepared except that the emulsions prepared in Example 1 having been spectrally sensitized with dyes shown in Table 5 were used as Emulsion X in the ninth layer (high-sensitivity green-sensitive emulsion layer).

TABLE 5

| | (Sample No.) | | |
|---|---|---|---|
| Dye No. | Emulsion (A) | Emulsion (B) | Emulsion (C) |
| 1 | 401 (Comparative Example) | 501 (Comparative Example) | 601 (Present Invention) |
| 3 | 402 (Comparative Example) | 502 (Comparative Example) | 602 (Present Invention) |
| 4 | 403 (Comparative Example) | 503 (Comparative Example) | 603 (Present Invention) |
| 7 | 404 (Comparative Example) | 504 (Comparative Example) | 604 (Present Invention) |
| 9 | 405 (Comparative Example) | 505 (Comparative Example) | 605 (Present Invention) |
| 13 | 406 (Comparative Example) | 506 (Comparative Example) | 606 (Present Invention) |
| 15 | 407 (Comparative Example) | 507 (Comparative Example) | 607 (Present Invention) |
| 17 | 408 (Comparative Example) | 508 (Comparative Example) | 608 (Present Invention) |
| 22 | 409 (Comparative Example) | 509 (Comparative Example) | 609 (Present Invention) |
| 23 | 410 (Comparative Example) | 510 (Comparative Example) | 610 (Present Invention) |
| 38 | 411 (Comparative Example) | 511 (Comparative Example) | 611 (Present Invention) |
| 32 | 412 (Comparative Example) | 512 (Comparative Example) | 612 (Present Invention) |
| Comparative Dye | 413 (Comparative Example) | 513 (Comparative Example) | 613 (Comparative Example) |

TABLE 5-continued

These Samples Nos. 401 to 613 were subjected to green sensitometrical exposure (1/100 second) and then rapidly processed according to the same process as in Example 1.

From the characteristic curve of the magenta image in each of the thus-processed samples, the toe sensitivity was obtained. This is shown in Table 6 below, as a relative value based on the sensitivity (100) of Sample 401.

TABLE 6

| | (Toe Sensitivity) | | |
|---|---|---|---|
| Dye No. | Emulsion (A) | Emulsion (B) | Emulsion (C) |
| 1 | 100 | 140 | 300 |
| 3 | 100 | 140 | 290 |
| 4 | 95 | 135 | 280 |
| 7 | 95 | 140 | 290 |
| 9 | 105 | 140 | 295 |

TABLE 6-continued

| Dye No. | (Toe Sensitivity) Emulsion (A) | Emulsion (B) | Emulsion (C) |
|---|---|---|---|
| 13 | 110 | 140 | 310 |
| 15 | 95 | 140 | 295 |
| 17 | 95 | 135 | 290 |
| 22 | 100 | 140 | 295 |
| 23 | 95 | 135 | 290 |
| 38 | 95 | 140 | 220 |
| 32 | 95 | 135 | 180 |
| Comparative Dye | 80 | 135 | 110 |

These samples were stored at 50° C. and 80% RH for 2 days to evaluate their storability.

After thus stored, the storability of each sample was evaluated on the basis of the characteristic curve of the yellow image formed. Precisely, the sensitivity of each sample, as defined by the reciprocal of the amount of exposure to give an yellow density higher than the fog density by 1.0, was obtained from the characteristic curve of each sample, and this was represented as a relative value based on the value (10) of Sample 401. The storability of the samples thus obtained is shown in Table 7 below.

TABLE 7

| Dye No. | (Storability) Emulsion (A) | Emulsion (B) | Emulsion (C) |
|---|---|---|---|
| 1 | 10 | 10 | 10 |
| 3 | 10 | 10 | 10 |
| 4 | 11 | 10 | 11 |
| 7 | 11 | 10 | 11 |
| 9 | 10 | 10 | 10 |
| 13 | 10 | 10 | 10 |
| 15 | 11 | 10 | 11 |
| 17 | 10 | 10 | 11 |
| 22 | 11 | 10 | 12 |
| 23 | 10 | 10 | 12 |
| 38 | 11 | 10 | 12 |
| 32 | 15 | 10 | 35 |
| Comparative Dye | 25 | 10 | 105 |

From Tables 6 and 7, it is known that the samples containing the particular emulsion of the present invention have a high sensitivity and can be processed rapidly and that these have improved storability.

As has been demonstrated by Example 1 and Example 2 mentioned above, the silver halide photographic material of the present invention has a high sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide emulsion which contains tabular silver halide grains having {100} faces as the parallel two major planes, having an aspect ratio of 2 or more and having a mean silver chloride content of 50 mol % or more, in an amount of 50% or more of the total projected area of all the silver halide grains therein, and which is spectrally sensitized with a dye represented by formula (I):

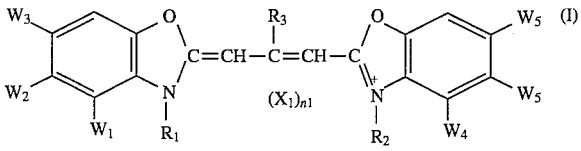

(I)

wherein $W_1$, $W_3$, $W_4$ and $W_6$ each represents a hydrogen atom; and $W_2$ and $W_5$ each represents a substituted phenyl group;

$R_1$ and $R_2$ may be the same or different and each represents an unsubstituted or substituted alkyl or alkenyl group having 10 or less carbon atoms in total, and at least one of $R_1$ and $R_2$ has a sulfo group or a carboxyl group;

$R_3$ represents a lower alkyl group or a phenyl-substituted alkyl group;

$X_1$ represents a pair ion necessary for neutralizing the charge of the compound; and $n_1$ represents 0 or 1, and when the compound is an internal salt, $n_1$ is 0.

2. A silver halide photographic material comprising a support having provided thereon at least one silver halide emulsion layer containing the silver halide emulsion as claimed in claim 1.

3. The silver halide photographic material as claimed in claim 2, in which the tabular silver halide grains in the emulsion layer are sensitized by gold-sensitization and sulfur-sensitization.

4. The silver halide photographic material as claimed in claim 2, in which the tabular silver halide grains in the emulsion layer are sensitized by gold-sensitization and sulfur-sensitization in the presence of a dye represented by the formula (I).

5. The silver halide emulsion as claimed in claim 1, wherein said substituent for the substituted phenyl group is selected from the group consisting of Cl, Br, $CH_3O$, $C_2H_5O$, $CH_3$, and $C_2H_5$.

* * * * *